US008590340B2

(12) United States Patent
Pitman et al.

(10) Patent No.: US 8,590,340 B2
(45) Date of Patent: Nov. 26, 2013

(54) HYDROCARBON GAS PROCESSING

(75) Inventors: Richard N. Pitman, Sunset, TX (US); John D. Wilkinson, Midland, TX (US); Joe T. Lynch, Midland, TX (US); Hank M. Hudson, Midland, TX (US); Tony L. Martinez, Odessa, TX (US)

(73) Assignee: Ortoff Engineers, Ltd., Midland, TX (US)

( * ) Notice: Subject to any disclaimer, the term of this patent is extended or adjusted under 35 U.S.C. 154(b) by 1131 days.

(21) Appl. No.: 11/971,491

(22) Filed: Jan. 9, 2008

(65) Prior Publication Data

US 2008/0190136 A1 Aug. 14, 2008

Related U.S. Application Data

(60) Provisional application No. 60/900,400, filed on Feb. 9, 2007.

(51) Int. Cl.
*F25J 3/00* (2006.01)
*B01D 19/00* (2006.01)

(52) U.S. Cl.
USPC ..... 62/621; 62/620; 62/628; 62/630; 62/625; 95/184

(58) Field of Classification Search
USPC ..... 62/621, 611, 643; 95/184
See application file for complete search history.

(56) References Cited

U.S. PATENT DOCUMENTS 2,952,984 A 9/1960 Marshall ..... 62/622
3,292,380 A 12/1966 Bucklin ..... 62/621

(Continued)

FOREIGN PATENT DOCUMENTS

EP 1 114 808 B1 12/2003
WO WO 99/23428 5/1999

(Continued)

OTHER PUBLICATIONS

PCT Notification of Transmittal of the International Search Report and the Written Opinion of The International Searching Authority, or The Declaration (Form PCT/ISA/220); PCT International Search Report (Form PCT/ISA/210); PCT Written Opinion of The International Searching Authority (Form PCT/ISA/237), regarding International Appln. PCT/US 08/52154.

(Continued)

*Primary Examiner* — Khoa Huynh
*Assistant Examiner* — Timothy K Trieu
(74) *Attorney, Agent, or Firm* — Fitzpatrick, Cella, Harper & Scinto

(57) ABSTRACT

A process and apparatus for the recovery of ethane, ethylene, propane, propylene, and heavier hydrocarbon components from a hydrocarbon gas stream is disclosed. The stream is cooled and divided into first and second streams. The first stream is further cooled to condense substantially all of it and is thereafter expanded to the pressure of a fractionation tower and supplied to the fractionation tower at a first mid-column feed position. The second stream is expanded to the tower pressure and is then supplied to the column at a second mid-column feed position. A distillation vapor stream is withdrawn from the column below the feed point of the first stream and compressed to an intermediate pressure, and is then directed into heat exchange relation with the tower overhead vapor stream to cool the distillation stream and condense substantially all of it, forming a condensed stream. At least a portion of the condensed stream is directed to the fractionation tower at a third mid-column feed position located above the feed point of the first stream. A recycle stream is withdrawn from the tower overhead after it has been warmed and compressed. The compressed recycle stream is cooled sufficiently to substantially condense it, and is then expanded to the pressure of the fractionation tower and supplied to the tower at a top column feed position. The quantities and temperatures of the feeds to the fractionation tower are effective to maintain the overhead temperature of the fractionation tower at a temperature whereby the major portion of the desired components is recovered.

34 Claims, 8 Drawing Sheets

(56) References Cited

U.S. PATENT DOCUMENTS

| | | | | |
|---|---|---|---|---|
| 3,837,172 | A | 9/1974 | Markbreiter et al. | 62/621 |
| 4,061,481 | A | 12/1977 | Campbell et al. | 62/621 |
| 4,140,504 | A | 2/1979 | Campbell et al. | 62/621 |
| 4,157,904 | A | 6/1979 | Campbell et al. | 62/623 |
| 4,171,964 | A | 10/1979 | Campbell et al. | 62/621 |
| 4,185,978 | A | 1/1980 | McGalliard et al. | 62/634 |
| 4,251,249 | A | 2/1981 | Gulsby | 62/621 |
| 4,278,457 | A | 7/1981 | Campbell et al. | 62/621 |
| 4,445,917 | A | 5/1984 | Chiu | 62/625 |
| 4,519,824 | A | 5/1985 | Huebel | 62/621 |
| 4,525,185 | A | 6/1985 | Newton | 62/612 |
| 4,545,795 | A | 10/1985 | Liu et al. | 62/613 |
| 4,600,421 | A | 7/1986 | Kummann | 62/621 |
| 4,617,039 | A | 10/1986 | Buck | 62/621 |
| 4,687,499 | A | 8/1987 | Aghili | 62/621 |
| 4,689,063 | A | 8/1987 | Paradowski et al. | 62/627 |
| 4,690,702 | A | 9/1987 | Paradowski et al. | 62/621 |
| 4,698,081 | A | 10/1987 | Aghili et al. | 62/24 |
| 4,707,170 | A | 11/1987 | Ayres et al. | 62/627 |
| 4,710,214 | A | 12/1987 | Sharma et al. | 62/627 |
| 4,755,200 | A | 7/1988 | Liu et al. | 62/612 |
| 4,851,020 | A | 7/1989 | Montgomery, IV | 62/621 |
| 4,854,955 | A | 8/1989 | Campbell et al. | 62/621 |
| 4,869,740 | A | 9/1989 | Campbell et al. | 62/621 |
| 4,889,545 | A | 12/1989 | Campbell et al. | 62/621 |
| 4,895,584 | A | 1/1990 | Buck et al. | 62/621 |
| RE33,408 | E | 10/1990 | Khan et al. | 62/621 |
| 5,114,451 | A | 5/1992 | Rambo et al. | 62/623 |
| 5,275,005 | A | 1/1994 | Campbell et al. | 62/621 |
| 5,291,736 | A | 3/1994 | Paradowski | 62/613 |
| 5,363,655 | A | 11/1994 | Kikkawa et al. | 62/613 |
| 5,365,740 | A | 11/1994 | Kikkawa et al. | 62/613 |
| 5,555,748 | A | 9/1996 | Campbell et al. | 62/621 |
| 5,566,554 | A | 10/1996 | Vijayaraghavan et al. | 62/621 |
| 5,568,737 | A | 10/1996 | Campbell et al. | 62/621 |
| 5,600,969 | A | 2/1997 | Low | 62/622 |
| 5,615,561 | A | 4/1997 | Houshmand et al. | 62/611 |
| 5,651,269 | A | 7/1997 | Prevost et al. | 62/613 |
| 5,755,114 | A | 5/1998 | Foglietta | 62/618 |
| 5,755,115 | A | 5/1998 | Manley | 62/620 |
| 5,771,712 | A | 6/1998 | Campbell et al. | 62/621 |
| 5,799,507 | A | 9/1998 | Wilkinson et al. | 62/621 |
| 5,881,569 | A | 3/1999 | Campbell et al. | 62/621 |
| 5,890,378 | A | 4/1999 | Rambo et al. | 62/621 |
| 5,893,274 | A | 4/1999 | Nagelvoort et al. | 62/613 |
| 5,983,664 | A | 11/1999 | Campbell et al. | 62/621 |
| 6,014,869 | A | 1/2000 | Elion et al. | 62/621 |
| 6,023,942 | A | 2/2000 | Thomas et al. | 62/613 |
| 6,053,007 | A | 4/2000 | Victory et al. | 62/619 |
| 6,062,041 | A | 5/2000 | Kikkawa et al. | 62/613 |
| 6,116,050 | A * | 9/2000 | Yao et al. | 62/630 |
| 6,119,479 | A | 9/2000 | Roberts et al. | 62/612 |
| 6,125,653 | A | 10/2000 | Shu et al. | 62/622 |
| 6,182,469 | B1 * | 2/2001 | Campbell et al. | 62/621 |
| 6,250,105 | B1 | 6/2001 | Kimble | 62/613 |
| 6,269,655 | B1 | 8/2001 | Roberts et al. | 62/612 |
| 6,272,882 | B1 | 8/2001 | Hodges et al. | 62/613 |
| 6,308,531 | B1 | 10/2001 | Roberts et al. | 62/611 |
| 6,324,867 | B1 | 12/2001 | Fanning et al. | 62/613 |
| 6,336,344 | B1 | 1/2002 | O'Brien | 62/627 |
| 6,347,532 | B1 | 2/2002 | Agrawal et al. | 62/612 |
| 6,363,744 | B2 | 4/2002 | Finn et al. | 62/621 |
| 6,367,286 | B1 | 4/2002 | Price | 62/613 |
| 6,526,777 | B1 | 3/2003 | Campbell et al. | 62/621 |
| 6,578,379 | B2 | 6/2003 | Paradowski | 62/622 |
| 6,712,880 | B2 * | 3/2004 | Foglietta et al. | 95/184 |
| 6,742,358 | B2 | 6/2004 | Wilkinson et al. | 62/613 |
| 6,915,662 | B2 | 7/2005 | Wilkinson et al. | 62/621 |
| 6,945,075 | B2 | 9/2005 | Wilkinson et al. | 62/620 |
| 7,107,788 | B2 | 9/2006 | Patel et al. | 62/625 |
| 7,191,617 | B2 | 3/2007 | Cuellar et al. | 62/628 |
| 7,219,513 | B1 | 5/2007 | Mostafa | 62/620 |
| 2002/0166336 | A1 | 11/2002 | Wilkinson et al. | 62/620 |
| 2003/0158458 | A1 | 8/2003 | Prim | 585/800 |
| 2006/0032269 | A1 * | 2/2006 | Cuellar et al. | 62/620 |
| 2006/0283207 | A1 * | 12/2006 | Pitman et al. | 62/620 |
| 2008/0078205 | A1 | 4/2008 | Cuellar et al. | 62/620 |

FOREIGN PATENT DOCUMENTS

| | | |
|---|---|---|
| WO | WO 99/37962 | 7/1999 |
| WO | WO 00/33006 | 6/2000 |
| WO | WO 01/88447 A1 | 11/2001 |
| WO | WO 2004/076946 A2 | 9/2004 |
| WO | WO 2007/001669 A2 | 1/2007 |

OTHER PUBLICATIONS

Mowrey, E. Ross, "Efficient, High Recovery of Liquids from Natural Gas Utilizing a High Pressure Absorber", Proceedings of the Eighty-First Annual Convention of the Gas Processors Association, Dallas, Texas, Mar. 11-13, 2002, 12 sheets.

Kikkawa et al., "Optimize the Power System of Baseload LNG Plant", Proceedings of the Eightieth Annual Convention of the Gas Processors Association, San Antonio, Texas, Mar. 12-14, 2001, 23 sheets.

Finn et al., "LNG Technology for Offshore and Mid-scale Plants", Proceedings of the Seventy-ninth Annual Convention of the Gas Processors Association, Atlanta, Georgia, Mar. 13-15, 2003, 23 sheets.

B. C. Price, "LNG Production for Peak Shaving Operations", Proceedings of the Seventy-eighth Annual Convention of the Gas Processors Association, Nashville, Tennessee, Mar. 1-3, 1999, 8 sheets.

FIG. 16-33, on p. 16-24 of the Engineering Data Book, Twelfth Edition, published by the Gas Processors Suppliers Association 2004.

PCT Notification of Transmittal of The International Search Report and The Written Opinion of The International Searching Authority, or The Declaration (Form PCT/ISA/220); PCT International Search Report (Form PCT/ISA/210); PCT Written Opinion of The International Searching Authority (Form PCT/ISA/237), regarding International Appln. PCT/US 07/76199.

* cited by examiner

HYDROCARBON GAS PROCESSING

This invention relates to a process for the separation of a gas containing hydrocarbons. The applicants claim the benefits under Title 35, United States Code, Section 119(e) of prior U.S. Provisional Application No. 60/900,400 which was filed on Feb. 9, 2007.

BACKGROUND OF THE INVENTION

Ethylene, ethane, propylene, propane, and/or heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Natural gas usually has a major proportion of methane and ethane, i.e., methane and ethane together comprise at least 50 mole percent of the gas. The gas also contains relatively lesser amounts of heavier hydrocarbons such as propane, butanes, pentanes, and the like, as well as hydrogen, nitrogen, carbon dioxide, and other gases.

The present invention is generally concerned with the recovery of ethylene, ethane, propylene, propane, and heavier hydrocarbons from such gas streams. A typical analysis of a gas stream to be processed in accordance with this invention would be, in approximate mole percent, 92.5% methane, 4.2% ethane and other $C_2$ components, 1.3% propane and other $C_3$ components, 0.4% iso-butane, 0.3% normal butane, 0.5% pentanes plus, with the balance made up of nitrogen and carbon dioxide. Sulfur containing gases are also sometimes present.

The historically cyclic fluctuations in the prices of both natural gas and its natural gas liquid (NGL) constituents have at times reduced the incremental value of ethane, ethylene, propane, propylene, and heavier components as liquid products. This has resulted in a demand for processes that can provide more efficient recoveries of these products. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane, ethylene, and heavier hydrocarbons content) of the gas, and the desired end products, each of these processes or a combination thereof may be employed.

The cryogenic expansion process is now generally preferred for natural gas liquids recovery because it provides maximum simplicity with ease of startup, operating flexibility, good efficiency, safety, and good reliability. U.S. Pat. Nos. 3,292,380; 4,061,481; 4,140,504; 4,157,904; 4,171,964; 4,185,978; 4,251,249; 4,278,457; 4,519,824; 4,617,039; 4,687,499; 4,689,063; 4,690,702; 4,854,955; 4,869,740; 4,889,545; 5,275,005; 5,555,748; 5,566,554; 5,568,737; 5,771,712; 5,799,507; 5,881,569; 5,890,378; 5,983,664; 6,182,469; 6,578,379; 6,712,880; 6,915,662; 7,191,617; 7,219,513; reissue U.S. Pat. No. 33,408; and co-pending application Ser. Nos. 11/430,412 and 11/839,693 describe relevant processes (although the description of the present invention in some cases is based on different processing conditions than those described in the cited U.S. Patents).

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_2$+ or $C_3$+ components. Depending on the richness of the gas and the amount of liquids formed, the high-pressure liquids may be expanded to a lower pressure and fractionated. The vaporization occurring during expansion of the liquids results in further cooling of the stream. Under some conditions, pre-cooling the high pressure liquids prior to the expansion may be desirable in order to further lower the temperature resulting from the expansion. The expanded stream, comprising a mixture of liquid and vapor, is fractionated in a distillation (demethanizer or deethanizer) column. In the column, the expansion cooled stream(s) is (are) distilled to separate residual methane, nitrogen, and other volatile gases as overhead vapor from the desired $C_2$ components, $C_3$ components, and heavier hydrocarbon components as bottom liquid product, or to separate residual methane, $C_2$ components, nitrogen, and other volatile gases as overhead vapor from the desired $C_3$ components and heavier hydrocarbon components as bottom liquid product.

If the feed gas is not totally condensed (typically it is not), the vapor remaining from the partial condensation can be split into two streams. One portion of the vapor is passed through a work expansion machine or engine, or an expansion valve, to a lower pressure at which additional liquids are condensed as a result of further cooling of the stream. The pressure after expansion is essentially the same as the pressure at which the distillation column is operated. The combined vapor-liquid phases resulting from the expansion are supplied as feed to the column.

The remaining portion of the vapor is cooled to substantial condensation by heat exchange with other process streams, e.g., the cold fractionation tower overhead. Some or all of the high-pressure liquid may be combined with this vapor portion prior to cooling. The resulting cooled stream is then expanded through an appropriate expansion device, such as an expansion valve, to the pressure at which the demethanizer is operated. During expansion, a portion of the liquid will usually vaporize, resulting in cooling of the total stream. The flash expanded stream is then supplied as top feed to the demethanizer. Typically, the vapor portion of the flash expanded stream and the demethanizer overhead vapor combine in an upper separator section in the fractionation tower as residual methane product gas. Alternatively, the cooled and expanded stream may be supplied to a separator to provide vapor and liquid streams. The vapor is combined with the tower overhead and the liquid is supplied to the column as a top column feed.

In the ideal operation of such a separation process, the residue gas leaving the process will contain substantially all of the methane in the feed gas with essentially none of the heavier hydrocarbon components and the bottoms fraction leaving the demethanizer will contain substantially all of the heavier hydrocarbon components with essentially no methane or more volatile components. In practice, however, this ideal situation is not obtained because the conventional demethanizer is operated largely as a stripping column. The methane product of the process, therefore, typically comprises vapors leaving the top fractionation stage of the column, together with vapors not subjected to any rectification step. Considerable losses of $C_2$, $C_3$, and $C_4$+ components occur because the top liquid feed contains substantial quantities of these components and heavier hydrocarbon components, resulting in corresponding equilibrium quantities of $C_2$ components, $C_3$ components, $C_4$ components, and heavier hydrocarbon components in the vapors leaving the top fractionation stage of the demethanizer. The loss of these desirable components could be significantly reduced if the rising vapors could be brought into contact with a significant quantity of liquid (reflux) capable of absorbing the $C_2$ components, $C_3$ components, $C_4$ components, and heavier hydrocarbon components from the vapors.

In recent years, the preferred processes for hydrocarbon separation use an upper absorber section to provide additional rectification of the rising vapors. The source of the reflux stream for the upper rectification section is typically a recycled stream of residue gas supplied under pressure. The recycled residue gas stream is usually cooled to substantial condensation by heat exchange with other process streams, e.g., the cold fractionation tower overhead. The resulting substantially condensed stream is then expanded through an appropriate expansion device, such as an expansion valve, to the pressure at which the demethanizer is operated. During expansion, a portion of the liquid will usually vaporize, resulting in cooling of the total stream. The flash expanded stream is then supplied as top feed to the demethanizer. Typically, the vapor portion of the expanded stream and the demethanizer overhead vapor combine in an upper separator section in the fractionation tower as residual methane product gas. Alternatively, the cooled and expanded stream may be supplied to a separator to provide vapor and liquid streams, so that thereafter the vapor is combined with the tower overhead and the liquid is supplied to the column as a top column feed. Typical process schemes of this type are disclosed in U.S. Pat. Nos. 4,889,545; 5,568,737; and 5,881,569, co-pending application Ser. No. 11/430,412, and in Mowrey, E. Ross, "Efficient, High Recovery of Liquids from Natural Gas Utilizing a High Pressure Absorber", Proceedings of the Eighty-First Annual Convention of the Gas Processors Association, Dallas, Tex., Mar. 11-13, 2002.

The present invention also employs an upper rectification section (or a separate rectification column in some embodiments). However, two reflux streams are provided for this rectification section. The upper reflux stream is a recycled stream of residue gas as described above. In addition, however, a supplemental reflux stream is provided at one or more lower feed points by using a side draw of the vapors rising in a lower portion of the tower (which may be combined with a portion of the tower overhead vapor). Because the vapor streams lower in the tower contain a modest concentration of $C_2$ components and heavier components, this side draw stream can be substantially condensed by moderately elevating its pressure and using only the refrigeration available in the cold vapor leaving the upper rectification section. This condensed liquid, which is predominantly liquid methane and ethane, can then be used to absorb $C_2$ components, $C_3$ components, $C_4$ components, and heavier hydrocarbon components from the vapors rising through the lower portion of the upper rectification section and thereby capture these valuable components in the bottom liquid product from the demethanizer. Since this lower reflux stream captures much of the $C_2$ components and essentially all of the $C_3$+ components, only a relatively small flow rate of liquid in the upper reflux stream is needed to absorb the $C_2$ components remaining in the rising vapors and likewise capture these $C_2$ components in the bottom liquid product from the demethanizer.

In accordance with the present invention, it has been found that $C_2$ component recoveries in excess of 97 percent can be obtained. Similarly, in those instances where recovery of $C_2$ components is not desired, $C_3$ recoveries in excess of 98% can be maintained. In addition, the present invention makes possible essentially 100 percent separation of methane (or $C_2$ components) and lighter components from the $C_2$ components (or $C_3$ components) and heavier components at reduced energy requirements compared to the prior art while maintaining the same recovery levels. The present invention, although applicable at lower pressures and warmer temperatures, is particularly advantageous when processing feed gases in the range of 400 to 1500 psia [2,758 to 10,342 kPa(a)] or higher under conditions requiring NGL recovery column overhead temperatures of −50° F. [−46° C.] or colder.

For a better understanding of the present invention, reference is made to the following examples and drawings. Referring to the drawings:

FIG. 1 is a flow diagram of a prior art natural gas processing plant in accordance with U.S. Pat. No. 5,568,737;

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Système International d'Unités (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

DESCRIPTION OF THE PRIOR ART

Figure 1:
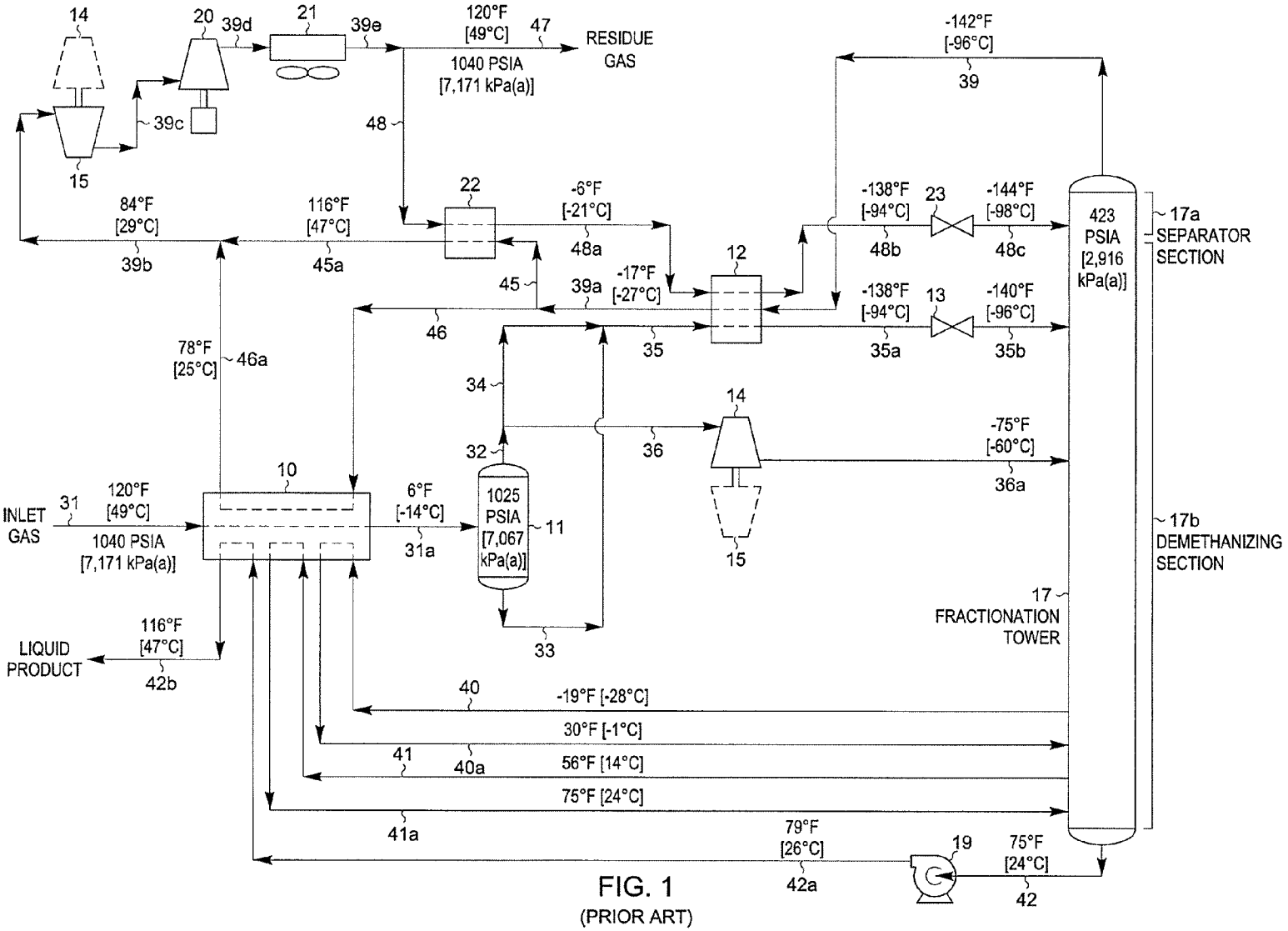
FIG. 1 (PRIOR ART)

FIG. 1 is a process flow diagram showing the design of a processing plant to recover $C_2$+ components from natural gas using prior art according to assignee's U.S. Pat. No. 5,568,737. In this simulation of the process, inlet gas enters the plant at 120° F. [49° C.] and 1040 psia [7,171 kPa(a)] as stream 31. If the inlet gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream 31 is cooled in heat exchanger 10 by heat exchange with a portion (stream 46) of cool distillation stream 39*a* at −17° F. [−27° C.], bottom liquid product at 79° F. [26° C.] (stream 42*a*) from the demethanizer bottoms pump, 19, demethanizer reboiler liquids at 56° F. [14° C.] (stream 41), and demethanizer side reboiler liquids at −19° F. [−28° C.] (stream 40). Note that in all cases exchanger 10 is representative of either a multitude of individual heat exchangers or a single multi-pass heat exchanger, or any combination thereof. (The decision as to whether to use more than one heat exchanger for the indicated cooling services will depend on a number of factors including, but not limited to, inlet gas flow rate, heat exchanger size, stream temperatures, etc.) The cooled stream 31*a* enters separator 11 at 6° F. [−14° C.] and 1025 psia [7,067 kPa(a)] where the vapor (stream 32) is separated from the condensed liquid (stream 33).

The vapor (stream 32) from separator 11 is divided into two streams, 34 and 36. Stream 34, containing about 30% of the total vapor, is combined with the separator liquid (stream 33). The combined stream 35 then passes through heat exchanger 12 in heat exchange relation with cold distillation stream 39 at −142° F. [−96° C.] where it is cooled to substantial condensation. The resulting substantially condensed stream 35*a* at −138° F. [−94° C.] is then flash expanded through an appropriate expansion device, such as expansion valve 13, to the operating pressure (approximately 423 psia [2,916 kPa(a)]) of fractionation tower 17. The expanded stream 35*b* leaving expansion valve 13 reaches a temperature of −140° F. [−96° C.] and is supplied to fractionation tower 17 at a mid-column feed point.

The remaining 70% of the vapor from separator 11 (stream 36) enters a work expansion machine 14 in which mechanical energy is extracted from this portion of the high pressure feed. The machine 14 expands the vapor substantially isentropically to the tower operating pressure, with the work expansion cooling the expanded stream 36*a* to a temperature of approximately −75° F. [−60° C.]. The typical commercially available expanders are capable of recovering on the order of 80-88% of the work theoretically available in an ideal isentropic expansion. The work recovered is often used to drive a centrifugal compressor (such as item 15) that can be used to re-compress the heated distillation stream (stream 39*b*), for example. The partially condensed expanded stream 36*a* is thereafter supplied to fractionation tower 17 at a second mid-column feed point.

The recompressed and cooled distillation stream 39*e* is divided into two streams. One portion, stream 47, is the volatile residue gas product. The other portion, recycle stream 48, flows to heat exchanger 22 where it is cooled to −6° F. [−21° C.] (stream 48*a*) by heat exchange with a portion (stream 45) of cool distillation stream 39*a*. The cooled recycle stream then flows to exchanger 12 where it is cooled to −138° F. [−94° C.] and substantially condensed by heat exchange with cold distillation stream 39 at −142° F. [−96° C.]. The substantially condensed stream 48*b* is then expanded through an appropriate expansion device, such as expansion valve 23, to the demethanizer operating pressure, resulting in cooling of the total stream to −144° F. [−98° C.]. The expanded stream 48*c* is then supplied to fractionation tower 17 as the top column feed. The vapor portion (if any) of stream 48*c* combines with the vapors rising from the top fractionation stage of the column to form distillation stream 39, which is withdrawn from an upper region of the tower.

The demethanizer in tower 17 is a conventional distillation column containing a plurality of vertically spaced trays, one or more packed beds, or some combination of trays and packing. As is often the case in natural gas processing plants, the fractionation tower may consist of two sections. The upper section 17*a* is a separator wherein the partially vaporized top feed is divided into its respective vapor and liquid portions, and wherein the vapor rising from the lower distillation or demethanizing section 17*b* is combined with the vapor portion (if any) of the top feed to form the cold demethanizer overhead vapor (stream 39) which exits the top of the tower at −142° F. [−96° C.]. The lower, demethanizing section 17*b* contains the trays and/or packing and provides the necessary contact between the liquids falling downward and the vapors rising upward. The demethanizing section 17*b* also includes reboilers (such as the reboiler and side reboiler described previously) which heat and vaporize a portion of the liquids flowing down the column to provide the stripping vapors which flow up the column to strip the liquid product, stream 42, of methane and lighter components.

Liquid product stream 42 exits the bottom of the tower at 75° F. [24° C.], based on a typical specification of a methane to ethane ratio of 0.025:1 on a molar basis in the bottom product. It is pumped to a pressure of approximately 650 psia [4,482 kPa(a)] in demethanizer bottoms pump 19, and the pumped liquid product is then warmed to 116° F. [47° C.] as it provides cooling of stream 31 in exchanger 10 before flowing to storage.

The demethanizer overhead vapor (stream 39) passes countercurrently to the incoming feed gas and recycle stream in heat exchanger 12 where it is heated to −17° F. [−27° C.] (stream 39*a*), and in heat exchanger 22 and heat exchanger 10 where it is heated to 84° F. [29° C.] (stream 39*b*). The distillation stream is then re-compressed in two stages. The first stage is compressor 15 driven by expansion machine 14. The second stage is compressor 20 driven by a supplemental power source which compresses stream 39*c* to sales line pressure (stream 39*d*). After cooling to 120° F. [49° C.] in discharge cooler 21, stream 39*e* is split into the residue gas product (stream 47) and the recycle stream 48 as described earlier. Residue gas stream 47 flows to the sales gas pipeline at 1040 psia [7,171 kPa(a)], sufficient to meet line requirements (usually on the order of the inlet pressure).

A summary of stream flow rates and energy consumption for the process illustrated in FIG. 1 is set forth in the following table:

TABLE I (FIG. 1)
Stream Flow Summary - Lb. Moles/Hr [kg moles/Hr]

| Stream | Methane | Ethane | Propane | Butanes+ | Total |
|---|---|---|---|---|---|
| 31 | 25,384 | 1,161 | 362 | 332 | 27,451 |
| 32 | 25,313 | 1,147 | 349 | 255 | 27,275 |
| 33 | 71 | 14 | 13 | 77 | 176 |
| 34 | 7,594 | 344 | 105 | 76 | 8,182 |
| 35 | 7,665 | 358 | 118 | 153 | 8,358 |
| 36 | 17,719 | 803 | 244 | 179 | 19,093 |
| 39 | 29,957 | 38 | 0 | 0 | 30,147 |
| 48 | 4,601 | 6 | 0 | 0 | 4,630 |
| 47 | 25,356 | 32 | 0 | 0 | 25,517 |
| 42 | 28 | 1,129 | 362 | 332 | 1,934 |

Recoveries*

| | |
|---|---|
| Ethane | 97.21% |
| Propane | 100.00% |
| Butanes+ | 100.00% |

Power

| | | |
|---|---|---|
| Residue Gas Compression | 13,857 HP | [22,781 kW] |

*(Based on un-rounded flow rates)

Figure 2:
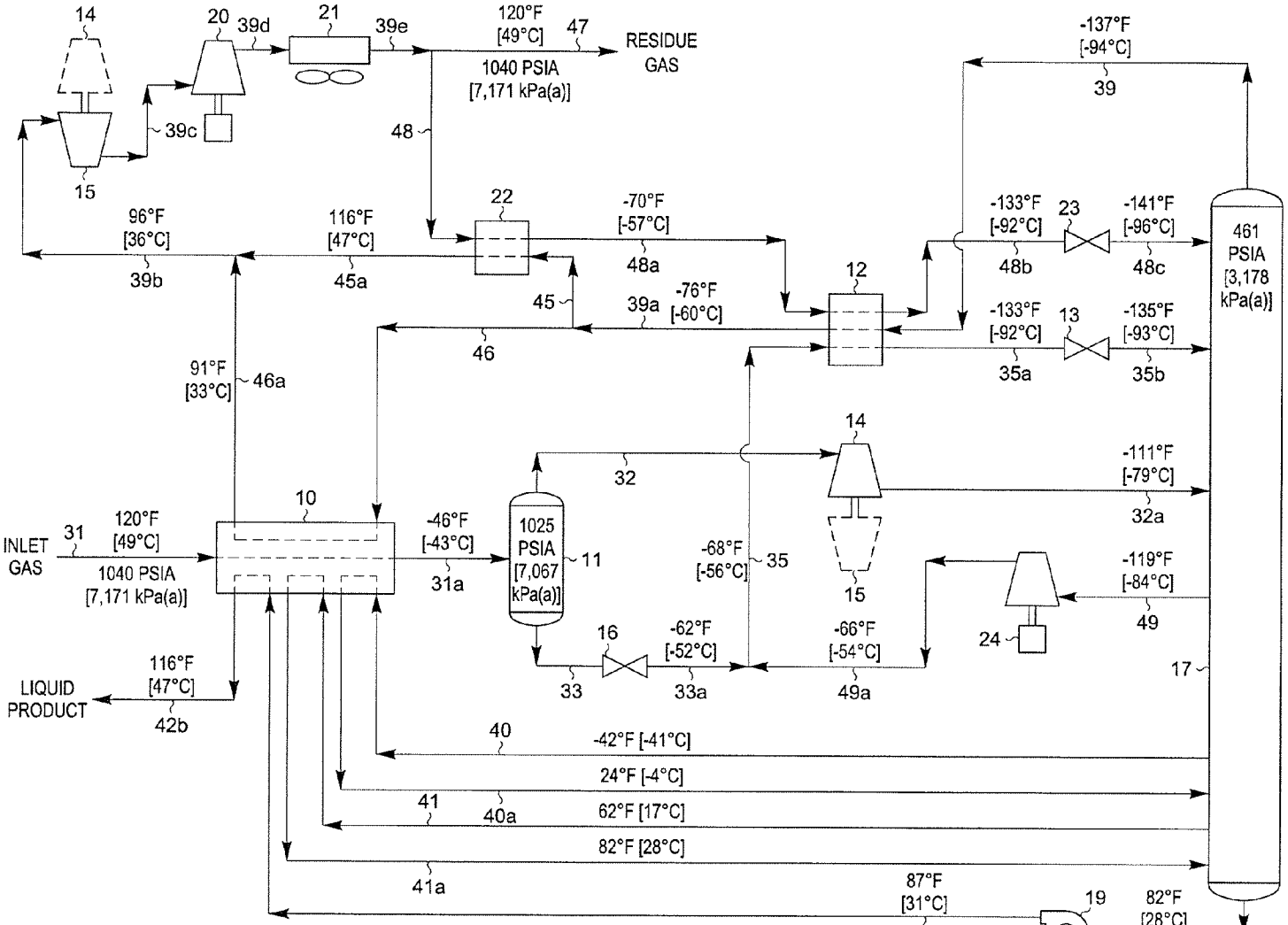
FIG. 2 (PRIOR ART)
FIG. 2 is a flow diagram of an alternative prior art natural gas processing plant in accordance with co-pending application Ser. No. 11/430,412.

FIG. 2 represents an alternative prior art process in accordance with co-pending application Ser. No. 11/430,412. The process of FIG. 2 has been applied to the same feed gas composition and conditions as described above for FIG. 1. In the simulation of this process, as in the simulation for the process of FIG. 1, operating conditions were selected to minimize energy consumption for a given recovery level.

The feed stream 31 is cooled in heat exchanger 10 by heat exchange with a portion of the cool distillation column overhead stream (stream 46) at −76° F. [−60° C.], demethanizer bottoms liquid (stream 42*a*) at 87° F. [31° C.], demethanizer reboiler liquids at 62° F. [17° C.] (stream 41), and demethanizer side reboiler liquids at −42° F. [−41° C.] (stream 40). The cooled stream 31*a* enters separator 11 at −46° F. [−43° C.] and 1025 psia [7,067 kPa(a)] where the vapor (stream 32) is separated from the condensed liquid (stream 33).

The separator vapor (stream 32) enters a work expansion machine 14 in which mechanical energy is extracted from this portion of the high pressure feed. The machine 14 expands the vapor substantially isentropically to the tower operating pressure of 461 psia [3,178 kPa(a)], with the work expansion cooling the expanded stream 32*a* to a temperature of approximately −111° F. [−79° C.]. The partially condensed expanded stream 32*a* is thereafter supplied to fractionation tower 17 at a mid-column feed point.

The recompressed and cooled distillation stream 39*e* is divided into two streams. One portion, stream 47, is the volatile residue gas product. The other portion, recycle stream 48, flows to heat exchanger 22 where it is cooled to −70° F. [−57° C.] (stream 48*a*) by heat exchange with a portion (stream 45) of cool distillation stream 39*a* at −76° F. [−60° C.]. The cooled recycle stream then flows to exchanger 12 where it is cooled to −133° F. [−92° C.] and substantially condensed by heat exchange with cold distillation column overhead stream 39. The substantially condensed stream 48*b* is then expanded through an appropriate expansion device, such as expansion valve 23, to the demethanizer operating pressure, resulting in cooling of the total stream to −141° F. [−96° C.]. The expanded stream 48*c* is then supplied to the fractionation tower as the top column feed. The vapor portion (if any) of stream 48*c* combines with the vapors rising from the top fractionation stage of the column to form distillation stream 39, which is withdrawn from an upper region of the tower.

A portion of the distillation vapor (stream 49) is withdrawn from fractionation tower 17 at −119° F. [−84° C.] and is compressed to about 727 psia [5,015 kPa(a)] by reflux compressor 24. The separator liquid (stream 33) is expanded to this pressure by expansion valve 16, and the expanded stream 33*a* at −62° F. [−52° C.] is combined with stream 49*a* at −66° F. [−54° C.]. The combined stream 35 is then cooled from −68° F. [−56° C.] to −133° F. [−92° C.] and condensed (stream 35*a*) in heat exchanger 12 by heat exchange with the cold demethanizer overhead stream 39 exiting the top of demethanizer 17 at −137° F. [−94° C.]. The resulting substantially condensed stream 35*a* is then flash expanded through expansion valve 13 to the operating pressure of fractionation tower 17, cooling stream 35*b* to a temperature of −135° F. [−93° C.] whereupon it is supplied to fractionation tower 17 at a mid-column feed point.

The liquid product stream 42 exits the bottom of the tower at 82° F. [28° C.], based on a typical specification of a methane to ethane ratio of 0.025:1 on a molar basis in the bottom product. Pump 19 delivers stream 42*a* to heat exchanger 10 as described previously where it is heated from 87° F. [31° C.] to 116° F. [47° C.] before flowing to storage.

The demethanizer overhead vapor stream 39 is warmed in heat exchanger 12 as it provides cooling to combined stream 35 and recycle stream 48*a* as described previously, and further heated in heat exchanger 22 and heat exchanger 10. The heated stream 39*b* at 96° F. [36° C.] is then re-compressed in two stages, compressor 15 driven by expansion machine 14 and compressor 20 driven by a supplemental power source. After stream 39*d* is cooled to 120° F. [49° C.] in discharge cooler 21 to form stream 39*e*, recycle stream 48 is withdrawn as described earlier to form residue gas stream 47 which flows to the sales gas pipeline at 1040 psia [7,171 kPa(a)].

A summary of stream flow rates and energy consumption for the process illustrated in FIG. 2 is set forth in the following table:

TABLE II (FIG. 2)
Stream Flow Summary - Lb. Moles/Hr [kg moles/Hr]

| Stream | Methane | Ethane | Propane | Butanes+ | Total |
|---|---|---|---|---|---|
| 31 | 25,384 | 1,161 | 362 | 332 | 27,451 |
| 32 | 24,909 | 1,076 | 297 | 166 | 26,655 |
| 33 | 475 | 85 | 65 | 166 | 796 |
| 49 | 5,751 | 117 | 6 | 1 | 5,910 |
| 35 | 6,226 | 202 | 71 | 167 | 6,706 |
| 39 | 29,831 | 38 | 0 | 0 | 30,006 |
| 48 | 4,475 | 6 | 0 | 0 | 4,501 |
| 47 | 25,356 | 32 | 0 | 0 | 25,505 |
| 42 | 28 | 1,129 | 362 | 332 | 1,946 |

Recoveries*

| | |
|---|---|
| Ethane | 97.24% |
| Propane | 100.00% |
| Butanes+ | 100.00% |

Power

| | | |
|---|---|---|
| Residue Gas Compression | 12,667 HP | [20,825 kW] |
| Reflux Compression | 664 HP | [1,092 kW] |
| Total Compression | 13,331 HP | [21,917 kW] |

*(Based on un-rounded flow rates)

Comparison of the recovery levels displayed in Tables I and II shows that the liquids recovery of the FIG. 2 process is essentially the same as that of the FIG. 1 process. However, the total power requirement for the FIG. 2 process is about 4% lower than that of the FIG. 1 process.

DESCRIPTION OF THE INVENTION

Example 1

Figure 3:
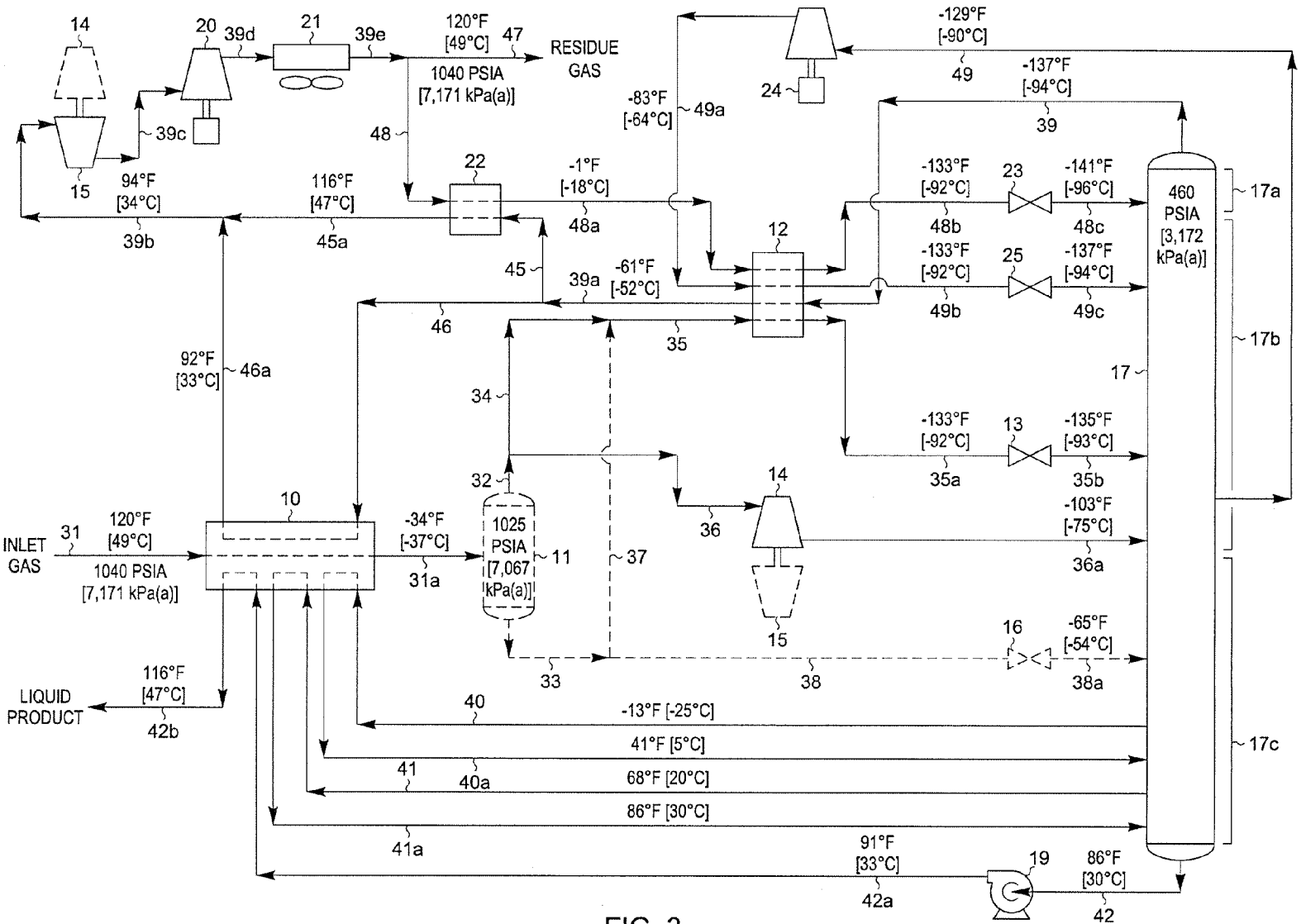
FIG. 3 is a flow diagram of a natural gas processing plant in accordance with the present invention.

FIG. 3 illustrates a flow diagram of a process in accordance with the present invention. The feed gas composition and conditions considered in the process presented in FIG. 3 are the same as those in FIGS. 1 and 2. Accordingly, the FIG. 3 process can be compared with that of the FIGS. 1 and 2 processes to illustrate the advantages of the present invention.

In the simulation of the FIG. 3 process, inlet gas enters the plant as stream 31 and is cooled in heat exchanger 10 by heat exchange with a portion (stream 46) of cool distillation stream 39*a* at −61° F. [−52° C.], the pumped demethanizer bottoms liquid (stream 42*a*) at 91° F. [33° C.], demethanizer liquids (stream 41) at 68° F. [20° C.], and demethanizer liquids (stream 40) at −13° F. [−25° C.]. The cooled stream 31*a* enters separator 11 at −34° F. [−37° C.] and 1025 psia [7,067 kPa(a)] where the vapor (stream 32) is separated from the condensed liquid (stream 33).

The vapor (stream 32) from separator 11 is divided into two streams, 34 and 36. Likewise, the liquid (stream 33) from separator 11 is divided into two streams, 37 and 38. Stream 34, containing about 10% of the total vapor, is combined with stream 37, containing about 50% of the total liquid. The combined stream 35 then passes through heat exchanger 12 in heat exchange relation with cold distillation stream 39 at −137° F. [−94° C.] where it is cooled to substantial condensation. The resulting substantially condensed stream 35*a* at −133° F. [−92° C.] is then flash expanded through an appropriate expansion device, such as expansion valve 13, to the operating pressure (approximately 460 psia [3,172 kPa(a)]) of fractionation tower 17, cooling stream 35*b* to −135° F. [−93° C.] before it is supplied to fractionation tower 17 at a mid-column feed point.

The remaining 90% of the vapor from separator 11 (stream 36) enters a work expansion machine 14 in which mechanical energy is extracted from this portion of the high pressure feed. The machine 14 expands the vapor substantially isentropically to the tower operating pressure, with the work expansion cooling the expanded stream 36*a* to a temperature of approximately −103° F. [−75° C.]. The partially condensed expanded stream 36*a* is thereafter supplied as feed to fractionation tower 17 at a second mid-column feed point.

The remaining 50% of the liquid from separator 11 (stream 38) is flash expanded through an appropriate expansion device, such as expansion valve 16, to the operating pressure of fractionation tower 17. The expansion cools stream 38*a* to −65° F. [−54° C.] before it is supplied to fractionation tower 17 at a third mid-column feed point.

The recompressed and cooled distillation stream 39*e* is divided into two streams. One portion, stream 47, is the volatile residue gas product. The other portion, recycle stream 48, flows to heat exchanger 22 where it is cooled to −1° F. [−18° C.] (stream 48*a*) by heat exchange with a portion (stream 45) of cool distillation stream 39*a*. The cooled recycle stream then flows to exchanger 12 where it is cooled to −133° F. [−92° C.] and substantially condensed by heat exchange with cold distillation stream 39. The substantially condensed stream 48*b* is then expanded through an appropriate expansion device, such as expansion valve 23, to the demethanizer operating pressure, resulting in cooling of the total stream to −141° F. [−96° C.]. The expanded stream 48*c* is then supplied to fractionation tower 17 as the top column feed. The vapor portion (if any) of stream 48*c* combines with the vapors rising from the top fractionation stage of the column to form distillation stream 39, which is withdrawn from an upper region of the tower.

A portion of the distillation vapor (stream 49) is withdrawn from the lower region of absorbing section 17*b* of fractionation tower 17 at −129° F. [−90° C.] and is compressed to an intermediate pressure of about 697 psia [4,804 kPa(a)] by reflux compressor 24. The compressed stream 49*a* flows to exchanger 12 where it is cooled to −133° F. [−92° C.] and substantially condensed by heat exchange with cold distillation column overhead stream 39. The substantially condensed stream 49*b* is then expanded through an appropriate expansion device, such as expansion valve 25, to the demethanizer operating pressure, resulting in cooling of stream 49*c* to a temperature of −137° F. [−94° C.], whereupon it is supplied to fractionation tower 17 at a fourth mid-column feed point.

The demethanizer in tower 17 is a conventional distillation column containing a plurality of vertically spaced trays, one or more packed beds, or some combination of trays and packing. The demethanizer tower consists of three sections: an upper separator section 17*a* wherein the top feed is divided into its respective vapor and liquid portions, and wherein the vapor rising from the intermediate absorbing section 17*b* is combined with the vapor portion (if any) of the top feed to form the cold demethanizer overhead vapor (stream 39); an intermediate absorbing (rectification) section 17*b* that contains the trays and/or packing to provide the necessary contact between the vapor portion of the expanded stream 36*a* rising upward and cold liquid falling downward to condense and absorb the $C_2$ components, $C_3$ components, and heavier components; and a lower, stripping (demethanizing) section 17*c* that contains the trays and/or packing to provide the necessary contact between the liquids falling downward and the vapors rising upward. The demethanizing section 17*c* also includes reboilers (such as the reboiler and side reboiler described previously) which heat and vaporize a portion of the liquids flowing down the column to provide the stripping vapors which flow up the column to strip the liquid product, stream 42, of methane and lighter components.

Stream 36*a* enters demethanizer 17 at a feed position located in the lower region of absorbing section 17*b* of demethanizer 17. The liquid portion of expanded stream 36*a* commingles with liquids falling downward from the absorbing section 17*b* and the combined liquid continues downward into the stripping section 17*c* of demethanizer 17. The vapor portion of expanded stream 36*a* rises upward through absorbing section 17*b* and is contacted with cold liquid falling downward to condense and absorb the $C_2$ components, $C_3$ components, and heavier components.

The expanded substantially condensed stream 49*c* is supplied as cold liquid reflux to an intermediate region in absorbing section 17*b* of demethanizer 17, as is expanded substantially condensed stream 35*b*. These secondary reflux streams absorb and condense most of the $C_3$ components and heavier components (as well as much of the $C_2$ components) from the vapors rising in the lower rectification region of absorbing section 17*b* so that only a small amount of recycle (stream 48) must be cooled, condensed, subcooled, and flash expanded to produce the top reflux stream 48*c* that provides the final rectification in the upper region of absorbing section 17*b*. As the cold top reflux stream 48*c* contacts the rising vapors in the upper region of absorbing section 17*b*, it condenses and absorbs the $C_2$ components and any remaining $C_3$ components and heavier components from the vapors so that they can be captured in the bottom product (stream 42) from demethanizer 17.

In stripping section 17*c* of demethanizer 17, the feed streams are stripped of their methane and lighter components. The resulting liquid product (stream 42) exits the bottom of tower 17 at 86° F. [30° C.], based on a typical specification of a methane to ethane ratio of 0.025:1 on a molar basis in the bottom product. Pump 19 delivers stream 42*a* to heat exchanger 10 as described previously where it is heated to 116° F. [47° C.] (stream 42*b*) before flowing to storage.

The distillation vapor stream forming the tower overhead (stream 39) is warmed in heat exchanger 12 as it provides cooling to combined stream 35, compressed distillation vapor stream 49*a*, and recycle stream 48*a* as described previously to form cool distillation stream 39*a*. Distillation stream 39*a* is divided into two portions (streams 45 and 46), which are heated to 116° F. [47° C.] and 92° F. [33° C.], respectively, in heat exchanger 22 and heat exchanger 10. Note that in all cases exchangers 10, 22, and 12 are representative of either a multitude of individual heat exchangers or a single multi-pass heat exchanger, or any combination thereof. (The decision as to whether to use more than one heat exchanger for the indicated heating services will depend on a number of factors including, but not limited to, inlet gas flow rate, heat exchanger size, stream temperatures, etc.) The heated streams recombine to form stream 39*b* at 94° F. [34° C.] which is then re-compressed in two stages, compressor 15 driven by expansion machine 14 and compressor 20 driven by a supplemental power source. After stream 39*d* is cooled to 120° F. [49° C.] in discharge cooler 21 to form stream 39*e*, recycle stream 48 is withdrawn as described earlier to form residue gas stream 47 which flows to the sales gas pipeline at 1040 psia [7,171 kPa(a)].

A summary of stream flow rates and energy consumption for the process illustrated in FIG. 3 is set forth in the following table:

TABLE III (FIG. 3)
Stream Flow Summary - Lb. Moles/Hr [kg moles/Hr]

| Stream | Methane | Ethane | Propane | Butanes+ | Total |
|---|---|---|---|---|---|
| 31 | 25,384 | 1,161 | 362 | 332 | 27,451 |
| 32 | 25,085 | 1,103 | 314 | 185 | 26,894 |
| 33 | 299 | 58 | 48 | 147 | 557 |
| 34 | 2,509 | 110 | 31 | 19 | 2,690 |
| 37 | 149 | 29 | 24 | 73 | 278 |
| 35 | 2,658 | 139 | 55 | 92 | 2,968 |
| 36 | 22,576 | 993 | 283 | 166 | 24,204 |
| 38 | 150 | 29 | 24 | 74 | 279 |
| 49 | 4,978 | 46 | 1 | 0 | 5,080 |
| 39 | 28,268 | 36 | 0 | 0 | 28,474 |
| 48 | 2,912 | 4 | 0 | 0 | 2,933 |
| 47 | 25,356 | 32 | 0 | 0 | 25,541 |
| 42 | 28 | 1,129 | 362 | 332 | 1,910 |

Recoveries*

| | |
|---|---|
| Ethane | 97.21% |
| Propane | 99.99% |
| Butanes+ | 100.00% |

Power

| | | |
|---|---|---|
| Residue Gas Compression | 11,841 HP | [19,466 kW] |
| Reflux Compression | 486 HP | [799 kW] |
| Total Compression | 12,327 HP | [20,265 kW] |

*(Based on un-rounded flow rates)

A comparison of Tables I, II, and III shows that, compared to the prior art processes, the present invention maintains essentially the same ethane recovery, propane recovery, and butanes+ recovery. However, comparison of Tables I, II, and III further shoes that these yields were achieved with substantially lower horsepower requirements than those of the prior art processes. The total power requirement of the present invention 11% lower than that of the FIG. 1 process and nearly 8% lower than that of the FIG. 2 process.

The key feature of the present invention is the supplemental rectification provided by reflux stream 49*c* in conjunction with stream 35*b*, which reduces the amount of $C_2$ components, $C_3$ components, and $C_4$+ components contained in the vapors rising in the upper region of absorbing section 17*b*. Compare these two supplemental reflux streams in Table III with the single supplemental reflux stream, 35*b*, in Table I for the FIG. 1 process. While the total supplemental reflux flow rate is about the same, the amount of $C_2$+ components in these reflux streams for the FIG. 3 process is only about one-half of that of the FIG. 1 process, making these streams much more effective at rectifying the $C_2$+ components in the vapors rising up in the lower region of absorbing section 17*b*. As a result, the methane recycle (stream 48) that is used to create the top reflux stream for fractionation tower 17 can be significantly less for the FIG. 3 process compared to the FIG. 1 process while maintaining the desired $C_2$ component recovery level, reducing the horsepower requirements for residue gas compression. Also, with the supplemental reflux supplied in two separate streams, one of which (stream 49*c*) has significantly lower concentrations of $C_2$+ components, it is possible to divide absorbing section 17*b* into multiple rectification zones and thus increase its efficiency.

A further advantage provided by supplemental reflux stream 49*c* is that it allows a reduction in the flow rate of supplemental reflux stream 35*b*, so that there is a corresponding increase in the flow rate of stream 36 to work expansion machine 14. This in turn provides a two-fold improvement in the process efficiency. First, with more flow to expansion machine 14, the increase in power recovery increases the refrigeration generated by the process. Second, the greater power recovery means more power available to compressor 15, reducing the external power consumption of compressor 20.

Compared to the FIG. 2 process, the present invention not only provides better supplemental reflux streams, but a higher total supplemental reflux flow rate as well. Compare supplemental reflux streams 49*c* and 35*b* in Table III with the single supplemental reflux stream, 35*b*, in Table II for the FIG. 2 process. The total supplemental reflux flow rate is about 20% higher for the present invention, and the amount of $C_2$+ components in these reflux streams is only about three-fourths of that of the FIG. 2 process. As a result, the flow rate of the methane recycle (stream 48) used as the top reflux stream for fractionation tower 17 in the FIG. 3 process is only two-thirds of that of the FIG. 2 process while maintaining the desired $C_2$ component recovery level, reducing the horsepower requirements for residue gas compression. Also, by supplying the supplemental reflux in two separate streams, one of which (stream 49*c*) has significantly lower concentrations of $C_2$+ components, it is possible to divide absorbing section 17*b* into multiple rectification zones and thus increase its efficiency.

Note that in the FIG. 2 process, the withdrawal location for distillation vapor stream 49 from fractionation tower 17 is below the mid-column feed point of expanded stream 32*a*. For the present invention, the withdrawal location can be higher up on the column, such as above the mid-column feed point of expanded stream 36*a* as in this example. As a result, distillation vapor stream 49 in the FIG. 3 process of the present invention can be subjected to more rectification, reducing the concentration of $C_2$+ components in the stream and improving its effectiveness as a reflux stream for absorbing section 17*b*. The location for the withdrawal of distillation vapor stream 49 of the present invention must be evaluated for each application.

Example 2

Figure 4:
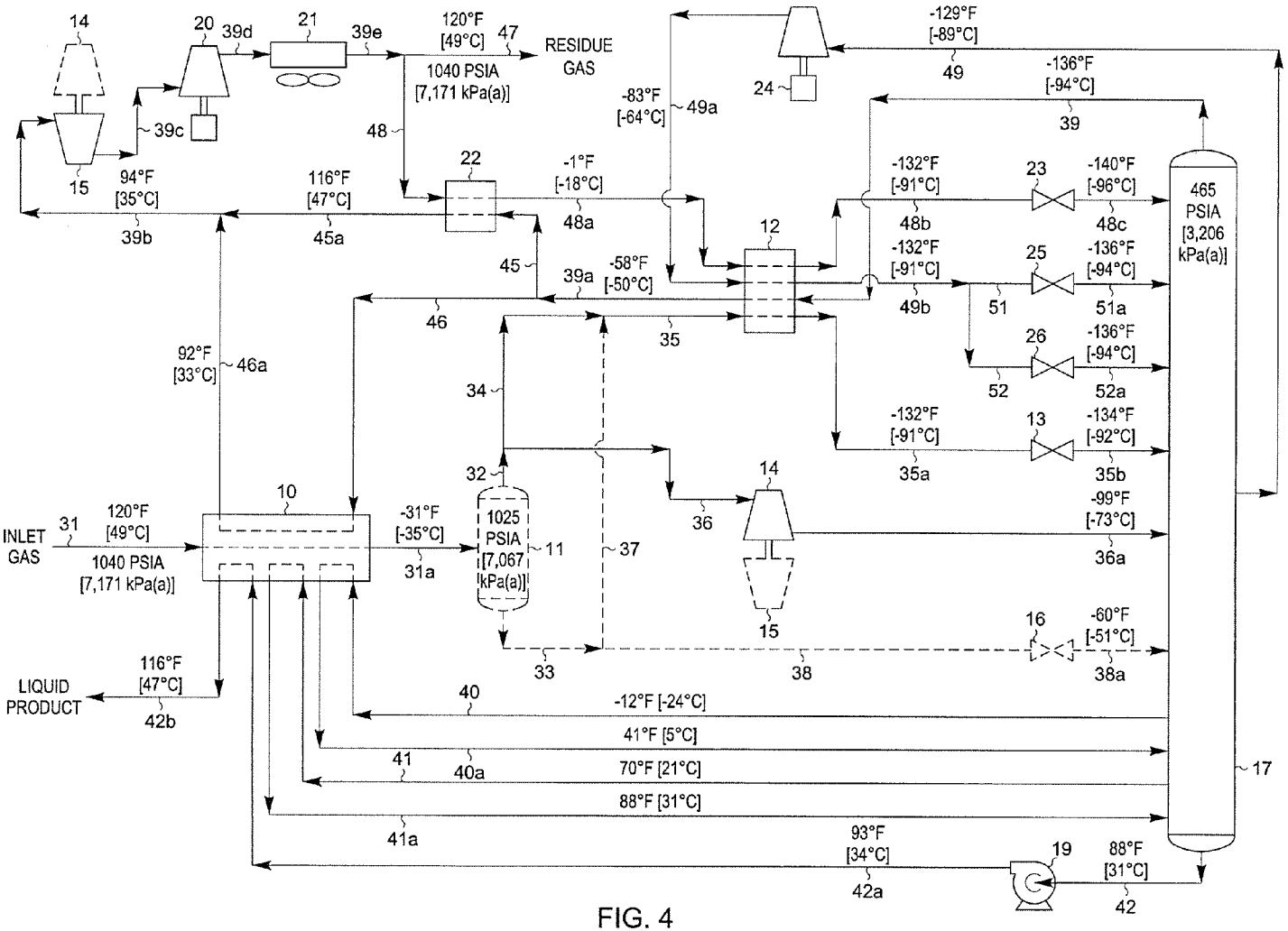
FIGS. 4 through 8 are flow diagrams illustrating alternative means of application of the present invention to a natural gas stream.

FIG. 3 represents the preferred embodiment of the present invention for the temperature and pressure conditions shown because it typically requires the least equipment and the lowest capital investment. An alternative method of using the supplemental reflux streams for the column is shown in another embodiment of the present invention as illustrated in FIG. 4. The feed gas composition and conditions considered in the process presented in FIG. 4 are the same as those in FIGS. 1 through 3. Accordingly, FIG. 4 can be compared with the FIGS. 1 and 2 processes to illustrate the advantages of the present invention, and can likewise be compared to the embodiment displayed in FIG. 3.

In the simulation of the FIG. 4 process, inlet gas enters the plant as stream 31 and is cooled in heat exchanger 10 by heat exchange with a portion (stream 46) of cool distillation stream 39*a* at −58° F. [−50° C.], the pumped demethanizer bottoms liquid (stream 42*a*) at 93° F. [34° C.], demethanizer liquids (stream 41) at 70° F. [21° C.], and demethanizer liquids (stream 40) at −12° F. [−24° C.]. The cooled stream 31*a* enters separator 11 at −31° F. [−35° C.] and 1025 psia [7,067 kPa(a)] where the vapor (stream 32) is separated from the condensed liquid (stream 33).

The vapor (stream 32) from separator 11 is divided into two streams, 34 and 36. Likewise, the liquid (stream 33) from separator 11 is divided into two streams, 37 and 38. Stream 34, containing about 11% of the total vapor, is combined with stream 37, containing about 50% of the total liquid. The combined stream 35 then passes through heat exchanger 12 in heat exchange relation with cold distillation stream 39 at −136° F. [−94° C.] where it is cooled to substantial condensation. The resulting substantially condensed stream 35*a* at −132° F. [−91° C.] is then flash expanded through an appropriate expansion device, such as expansion valve 13, to the operating pressure (approximately 465 psia [3,206 kPa(a)]) of fractionation tower 17, cooling stream 35*b* to −134° F. [−92° C.] before it is supplied to fractionation tower 17 at a mid-column feed point.

The remaining 89% of the vapor from separator 11 (stream 36) enters a work expansion machine 14 in which mechanical energy is extracted from this portion of the high pressure feed. The machine 14 expands the vapor substantially isentropically to the tower operating pressure, with the work expansion cooling the expanded stream 36*a* to a temperature of approximately −99° F. [−73° C.]. The partially condensed expanded stream 36*a* is thereafter supplied as feed to fractionation tower 17 at a second mid-column feed point.

The remaining 50% of the liquid from separator 11 (stream 38) is flash expanded through an appropriate expansion device, such as expansion valve 16, to the operating pressure of fractionation tower 17. The expansion cools stream 38*a* to −60° F. [−51° C.] before it is supplied to fractionation tower 17 at a third mid-column feed point.

The recompressed and cooled distillation stream 39*e* is divided into two streams. One portion, stream 47, is the volatile residue gas product. The other portion, recycle stream 48, flows to heat exchanger 22 where it is cooled to −1° F. [−18° C.] (stream 48*a*) by heat exchange with a portion (stream 45) of cool distillation stream 39*a*. The cooled recycle stream then flows to exchanger 12 where it is cooled to −132° F. [−91° C.] and substantially condensed by heat exchange with cold distillation stream 39. The substantially condensed stream 48*b* is then expanded through an appropriate expansion device, such as expansion valve 23, to the demethanizer operating pressure, resulting in cooling of the total stream to −140° F. [−96° C.]. The expanded stream 48*c* is then supplied to fractionation tower 17 as the top column feed. The vapor portion (if any) of stream 48*c* combines with the vapors rising from the top fractionation stage of the column to form distillation stream 39, which is withdrawn from an upper region of the tower.

A portion of the distillation vapor (stream 49) is withdrawn from the lower region of the absorbing section of fractionation tower 17 at −129° F. [−89° C.] and is compressed to an intermediate pressure of about 697 psia [4,804 kPa(a)] by reflux compressor 24. The compressed stream 49*a* flows to exchanger 12 where it is cooled to −132° F. [−91° C.] and substantially condensed by heat exchange with cold distillation column overhead stream 39. The substantially condensed stream 49*b* is then divided into two portions, streams 51 and 52. The first portion, stream 51 containing about 90% of stream 49*b*, is expanded through an appropriate expansion device, such as expansion valve 25, to the demethanizer operating pressure, resulting in cooling of stream 51*a* to a temperature of −136° F. [−94° C.], whereupon it is supplied to fractionation tower 17 at a fourth mid-column feed point as in the FIG. 3 embodiment of the present invention. The remaining portion, stream 52 containing about 10% of stream 49*b*, is expanded through an appropriate expansion device, such as expansion valve 26, to the demethanizer operating pressure, resulting in cooling of stream 52*a* to a temperature of −136° F. [−94° C.], whereupon it is supplied to fractionation tower 17 at a fifth mid-column feed point, located below the feed point of stream 51*a*.

In the stripping section of demethanizer 17, the feed streams are stripped of their methane and lighter components. The resulting liquid product (stream 42) exits the bottom of tower 17 at 88° F. [31° C.]. Pump 19 delivers stream 42*a* to heat exchanger 10 as described previously where it is heated to 116° F. [47° C.] (stream 42*b*) before flowing to storage.

The distillation vapor stream forming the tower overhead (stream 39) is warmed in heat exchanger 12 as it provides cooling to combined stream 35, compressed distillation vapor stream 49*a*, and recycle stream 48*a* as described previously to form cool distillation stream 39*a*. Distillation stream 39*a* is divided into two portions (streams 45 and 46), which are heated to 116° F. [47° C.] and 92° F. [33° C.], respectively, in heat exchanger 22 and heat exchanger 10. The heated streams recombine to form stream 39*b* at 94° F. [35° C.] which is then re-compressed in two stages, compressor 15 driven by expansion machine 14 and compressor 20 driven by a supplemental power source. After stream 39*d* is cooled to 120° F. [49° C.] in discharge cooler 21 to form stream 39*e*, recycle stream 48 is withdrawn as described earlier to form residue gas stream 47 which flows to the sales gas pipeline at 1040 psia [7,171 kPa(a)].

A summary of stream flow rates and energy consumption for the process illustrated in FIG. 4 is set forth in the following table:

TABLE IV (FIG. 4)
Stream Flow Summary - Lb. Moles/Hr [kg moles/Hr]

| Stream | Methane | Ethane | Propane | Butanes+ | Total |
|---|---|---|---|---|---|
| 31 | 25,384 | 1,161 | 362 | 332 | 27,451 |
| 32 | 25,118 | 1,109 | 318 | 190 | 26,943 |
| 33 | 266 | 52 | 44 | 142 | 508 |
| 34 | 2,838 | 125 | 36 | 21 | 3,045 |
| 37 | 133 | 26 | 22 | 71 | 254 |
| 35 | 2,971 | 151 | 58 | 92 | 3,299 |
| 36 | 22,280 | 984 | 282 | 169 | 23,898 |
| 38 | 133 | 26 | 22 | 71 | 254 |
| 49 | 4,902 | 50 | 1 | 0 | 5,000 |
| 51 | 4,412 | 45 | 1 | 0 | 4,500 |
| 52 | 490 | 5 | 0 | 0 | 500 |
| 39 | 28,490 | 36 | 0 | 0 | 28,702 |
| 48 | 3,134 | 4 | 0 | 0 | 3,157 |
| 47 | 25,356 | 32 | 0 | 0 | 25,545 |
| 42 | 28 | 1,129 | 362 | 332 | 1,906 |

Recoveries*

| | |
|---|---|
| Ethane | 97.22% |
| Propane | 99.99% |
| Butanes+ | 100.00% |

Power

| | | |
|---|---|---|
| Residue Gas Compression | 11,745 HP | [19,309 kW] |
| Reflux Compression | 465 HP | [764 kW] |
| Total Compression | 12,210 HP | [20,073 kW] |

*(Based on un-rounded flow rates)

A comparison of Tables III and IV shows that, compared to the FIG. 3 embodiment of the present invention, the FIG. 4 embodiment maintains essentially the same ethane recovery, propane recovery, and butanes+ recovery. However, comparison of Tables III and IV further shows that these yields were achieved using about 1% less horsepower than that required by the FIG. 3 embodiment. The drop in the power requirements for the FIG. 4 embodiment is mainly due to the slightly higher operating pressure of fractionation tower 17, which is possible due to the better rectification in its absorbing section provided by introducing a portion of the supplemental reflux (stream 52*a*) lower in the absorbing section. This effectively reduces the concentration of $C_2$+ components in the column liquids where expanded combined stream 35*b* is introduced, thereby reducing the equilibrium concentrations of these heavier components in the vapors rising above this region of the absorbing section. The reduction in power requirements for this embodiment over that of the FIG. 3 embodiment must be evaluated for each application relative to the slight increase in capital cost expected for the FIG. 4 embodiment compared to the FIG. 3 embodiment.

Example 3

Figure 5:
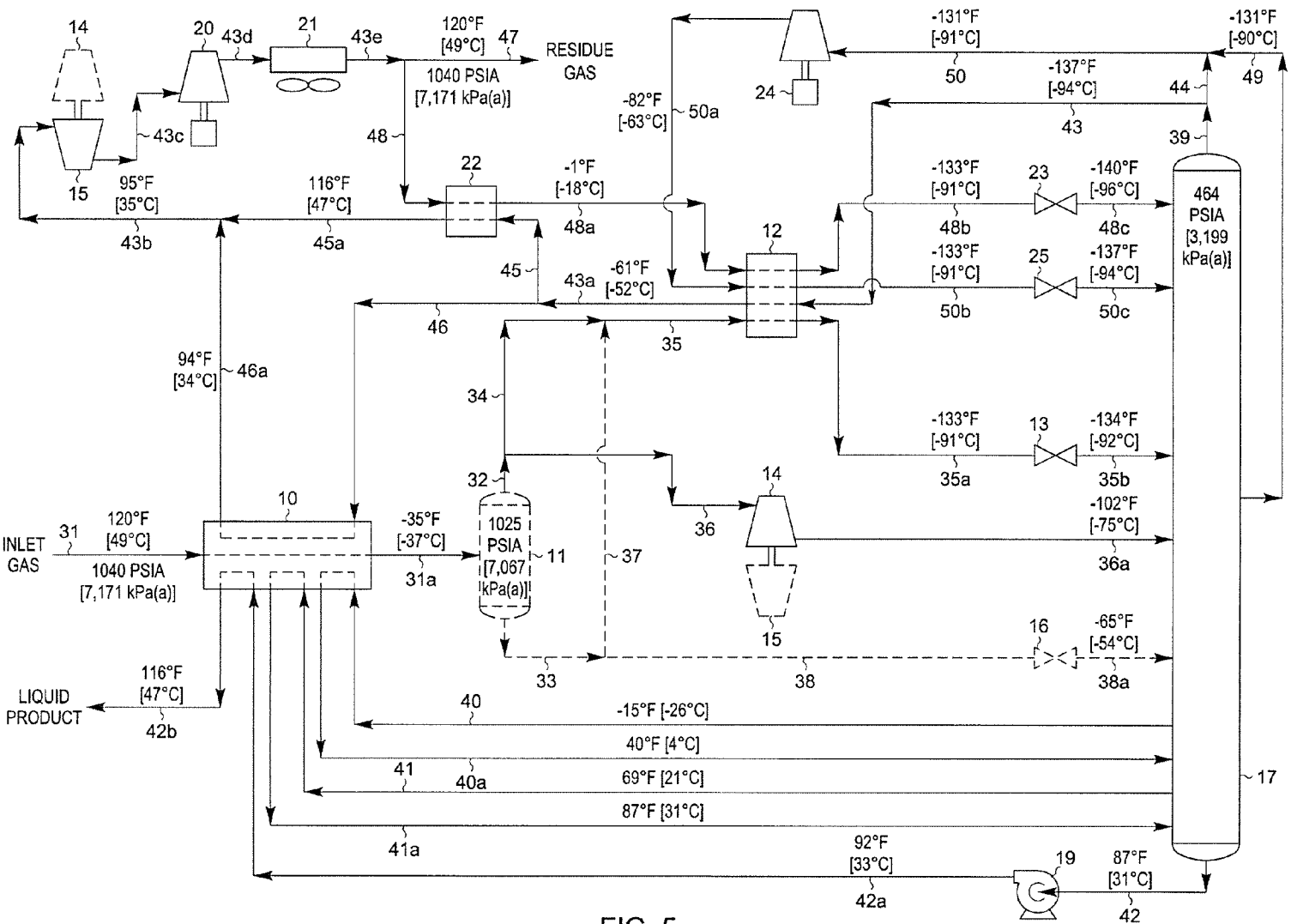

An alternative method of generating the supplemental reflux streams for the column is shown in another embodiment of the present invention as illustrated in FIG. 5. The feed gas composition and conditions considered in the process presented in FIG. 5 are the same as those in FIGS. 1 through 4. Accordingly, FIG. 5 can be compared with the FIGS. 1 and 2 processes to illustrate the advantages of the present invention, and can likewise be compared to the embodiments displayed in FIGS. 3 and 4.

In the simulation of the FIG. 5 process, inlet gas enters the plant as stream 31 and is cooled in heat exchanger 10 by heat exchange with a portion (stream 46) of cool vapor stream 43*a* at −61° F. [−52° C.], the pumped demethanizer bottoms liquid (stream 42*a*) at 92° F. [33° C.], demethanizer liquids (stream 41) at 69° F. [21° C.], and demethanizer liquids (stream 40) at −15° F. [−26° C.]. The cooled stream 31*a* enters separator 11 at −35° F. [−37° C.] and 1025 psia [7,067 kPa(a)] where the vapor (stream 32) is separated from the condensed liquid (stream 33).

The vapor (stream 32) from separator 11 is divided into two streams, 34 and 36. Likewise, the liquid (stream 33) from separator 11 is divided into two streams, 37 and 38. Stream 34, containing about 10% of the total vapor, is combined with stream 37, containing about 50% of the total liquid. The combined stream 35 then passes through heat exchanger 12 in heat exchange relation with cold vapor stream 43 at −137° F. [−94° C.] where it is cooled to substantial condensation. The resulting substantially condensed stream 35*a* at −133° F. [−91° C.] is then flash expanded through an appropriate expansion device, such as expansion valve 13, to the operating pressure (approximately 464 psia [3,199 kPa(a)]) of fractionation tower 17, cooling stream 35*b* to −134° F. [−92° C.] before it is supplied to fractionation tower 17 at a mid-column feed point.

The remaining 90% of the vapor from separator 11 (stream 36) enters a work expansion machine 14 in which mechanical energy is extracted from this portion of the high pressure feed. The machine 14 expands the vapor substantially isentropically to the tower operating pressure, with the work expansion cooling the expanded stream 36*a* to a temperature of approximately −102° F. [−75° C.]. The partially condensed expanded stream 36*a* is thereafter supplied as feed to fractionation tower 17 at a second mid-column feed point.

The remaining 50% of the liquid from separator 11 (stream 38) is flash expanded through an appropriate expansion device, such as expansion valve 16, to the operating pressure of fractionation tower 17. The expansion cools stream 38*a* to =65° F. [−54° C.] before it is supplied to fractionation tower 17 at a third mid-column feed point.

The recompressed and cooled vapor stream 43*e* is divided into two streams. One portion, stream 47, is the volatile residue gas product. The other portion, recycle stream 48, flows to heat exchanger 22 where it is cooled to −1° F. [−18° C.] (stream 48*a*) by heat exchange with a portion (stream 45) of cool vapor stream 43*a*. The cooled recycle stream then flows to exchanger 12 where it is cooled to −133° F. [−91° C.] and substantially condensed by heat exchange with cold vapor stream 43. The substantially condensed stream 48*b* is then expanded through an appropriate expansion device, such as expansion valve 23, to the demethanizer operating pressure, resulting in cooling of the total stream to −140° F. [−96° C.]. The expanded stream 48*c* is then supplied to fractionation tower 17 as the top column feed. The vapor portion (if any) of stream 48*c* combines with the vapors rising from the top fractionation stage of the column to form distillation stream 39, which is withdrawn from an upper region of the tower.

The distillation vapor stream forming the tower overhead (stream 39) leaves fractionation tower 17 at −137° F. [−94° C.] and is divided into two portions, first and second vapor streams 44 and 43, respectively. First vapor stream 44 is combined with a portion of the distillation vapor (stream 49) withdrawn from the lower region of the absorbing section of fractionation tower 17 at −131° F. [−90° C.], and the combined vapor stream 50 is compressed to an intermediate pressure of about 723 psia [4,985 kPa(a)] by reflux compressor 24. The compressed stream 50*a* flows to exchanger 12 where it is cooled to −133° F. [−91° C.] and substantially condensed by heat exchange with the remaining portion (stream 43) of cold distillation column overhead stream 39. The substantially condensed stream 50*b* is then expanded through an appropriate expansion device, such as expansion valve 25, to the demethanizer operating pressure, resulting in cooling of stream 50*c* to a temperature of −137° F. [−94° C.], whereupon it is supplied to fractionation tower 17 at a fourth mid-column feed point.

In the stripping section of demethanizer 17, the feed streams are stripped of their methane and lighter components. The resulting liquid product (stream 42) exits the bottom of tower 17 at 87° F. [31° C.]. Pump 19 delivers stream 42*a* to heat exchanger 10 as described previously where it is heated to 116° F. [47° C.] (stream 42*b*) before flowing to storage.

Second vapor stream 43 (the remaining portion of cold distillation column overhead stream 39) is warmed in heat exchanger 12 as it provides cooling to combined steam 35, compressed combined stream 50*a*, and recycle stream 48*a* as described previously to form cool second vapor stream 43*a*. Second vapor stream 43*a* is divided into two portions (streams 45 and 46), which are heated to 116° F. [47° C.] and 94° F. [34° C.], respectively, in heat exchanger 22 and heat exchanger 10. The heated streams recombine to form stream 43*b* at 95° F. [35° C.] which is then re-compressed in two stages, compressor 15 driven by expansion machine 14 and compressor 20 driven by a supplemental power source. After stream 43*d* is cooled to 120° F. [49° C.] in discharge cooler 21 to form stream 43*e*, recycle stream 48 is withdrawn as described earlier to form residue gas stream 47 which flows to the sales gas pipeline at 1040 psia [7,171 kPa(a)].

A summary of stream flow rates and energy consumption for the process illustrated in FIG. 5 is set forth in the following table:

TABLE V (FIG. 5)
Stream Flow Summary - Lb. Moles/Hr [kg moles/Hr]

| Stream | Methane | Ethane | Propane | Butanes+ | Total |
|---|---|---|---|---|---|
| 31 | 25,384 | 1,161 | 362 | 332 | 27,451 |
| 32 | 25,079 | 1,102 | 313 | 184 | 26,886 |
| 33 | 305 | 59 | 49 | 148 | 565 |
| 34 | 2,508 | 110 | 31 | 19 | 2,689 |
| 37 | 152 | 29 | 24 | 74 | 282 |
| 35 | 2,660 | 139 | 55 | 93 | 2,971 |
| 36 | 22,571 | 992 | 282 | 165 | 24,197 |
| 38 | 153 | 30 | 25 | 74 | 283 |
| 39 | 28,589 | 36 | 0 | 0 | 28,800 |
| 44 | 572 | 1 | 0 | 0 | 576 |
| 49 | 4,869 | 35 | 1 | 0 | 4,950 |
| 50 | 5,441 | 36 | 1 | 0 | 5,526 |
| 43 | 28,017 | 35 | 0 | 0 | 28,224 |
| 48 | 2,661 | 3 | 0 | 0 | 2,681 |
| 47 | 25,356 | 32 | 0 | 0 | 25,543 |
| 42 | 28 | 1,129 | 362 | 332 | 1,908 |

Recoveries*

| | |
|---|---|
| Ethane | 97.20% |
| Propane | 99.99% |
| Butanes+ | 100.00% |

Power

| | | |
|---|---|---|
| Residue Gas Compression | 11,617 HP | [19,098 kW] |
| Reflux Compression | 550 HP | [904 kW] |
| Total Compression | 12,167 HP | [20,002 kW] |

*(Based on un-rounded flow rates)

A comparison of Tables III, IV, and V shows that, compared to the FIG. 3 and FIG. 4 embodiments of the present invention, the FIG. 5 embodiment maintains essentially the same ethane recovery, propane recovery, and butanes+ recovery. However, comparison of Tables III, IV, and V further shows that these yields were achieved using about 1% less horsepower than that required by the FIG. 3 embodiment, and slightly less horsepower than the FIG. 4 embodiment. The drop in the power requirements for the FIG. 5 embodiment is mainly due to the reduction in the flow rate of recycle stream 48. This reduction in the flow rate of the top reflux to demethanizer 17 is possible because combining a portion (stream 44) of the column overhead (stream 39) with the portion of the distillation vapor (stream 49) withdrawn from the lower region of the absorbing section of fractionation tower 17 significantly reduces the concentration of $C_2$+ components in reflux stream 50*c*, providing better rectification in the absorbing section. This reduces the equilibrium concentrations of these heavier components in the vapors rising above this region of the absorbing section so that less rectification is required by the top reflux stream. The reduction in power requirements for this embodiment over that of the FIG. 3 embodiment must be evaluated for each application relative to the slight increase in capital cost for the FIG. 5 embodiment compared to the FIG. 3 embodiment. The FIG. 5 embodiment may offer a slight advantage in capital cost compared to the FIG. 4 embodiment, in addition to the power reduction, but this must likewise be evaluated for each application.

Example 4

Figure 6:
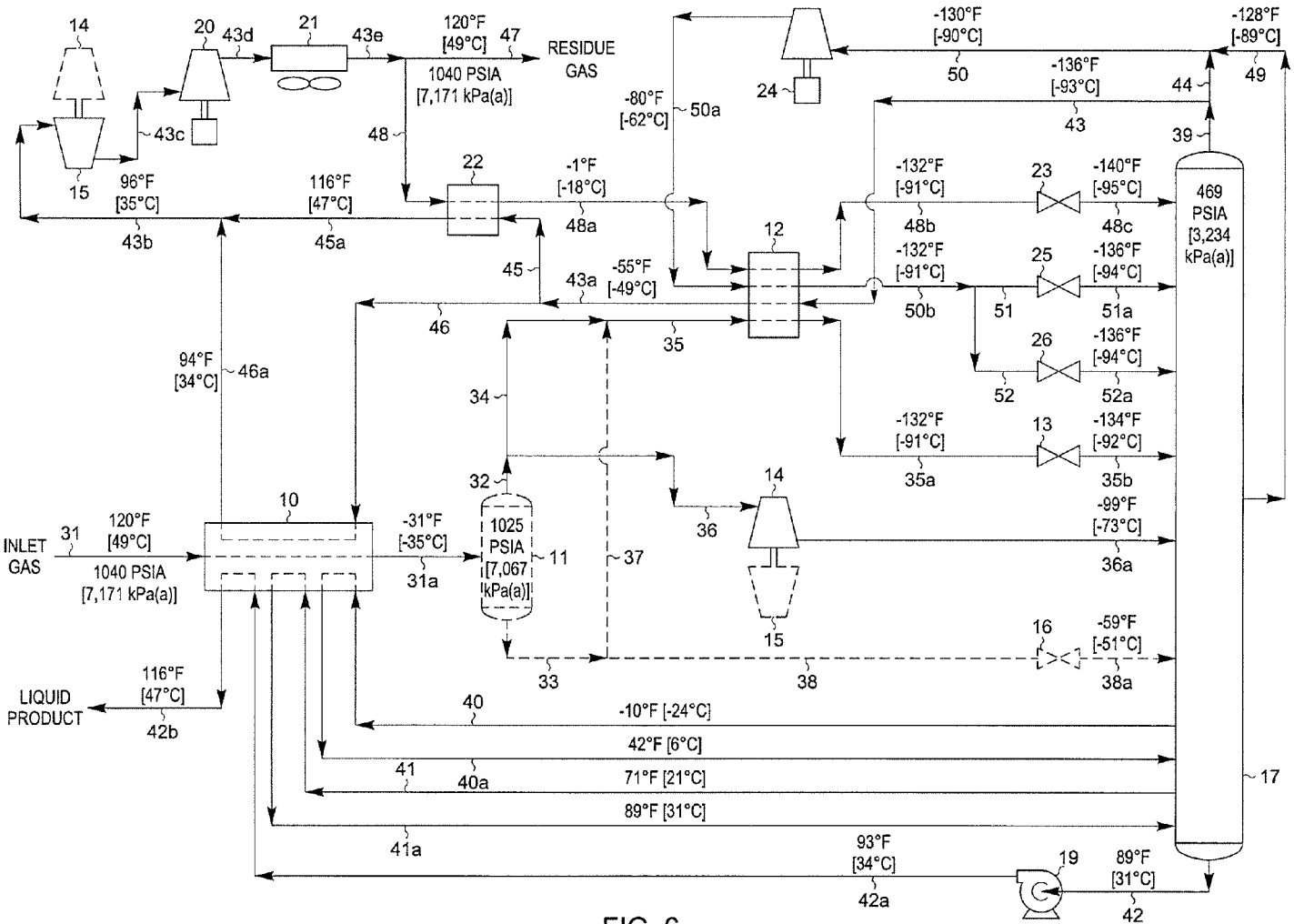

An alternative method of using the supplemental reflux streams for the column is shown in another embodiment of the present invention as illustrated in FIG. 6. The feed gas composition and conditions considered in the process presented in FIG. 6 are the same as those in FIGS. 1 through 5. Accordingly, FIG. 6 can be compared with the FIGS. 1 and 2 processes to illustrate the advantages of the present invention, and can likewise be compared to the embodiments displayed in FIGS. 3 through 5.

In the simulation of the FIG. 6 process, inlet gas enters the plant as stream 31 and is cooled in heat exchanger 10 by heat exchange with a portion (stream 46) of cool vapor stream 43*a* at −55° F. [−49° C.], the pumped demethanizer bottoms liquid (stream 42*a*) at 93° F. [34° C.], demethanizer liquids (stream 41) at 71° F. [21° C.], and demethanizer liquids (stream 40) at −10° F. [−24° C.]. The cooled stream 31*a* enters separator 11 at −31° F. [−35° C.] and 1025 psia [7,067 kPa(a)] where the vapor (stream 32) is separated from the condensed liquid (stream 33).

The vapor (stream 32) from separator 11 is divided into two streams, 34 and 36. Likewise, the liquid (stream 33) from separator 11 is divided into two streams, 37 and 38. Stream 34, containing about 12% of the total vapor, is combined with stream 37, containing about 50% of the total liquid. The combined stream 35 then passes through heat exchanger 12 in heat exchange relation with cold vapor stream 43 at −136° F. [−93° C.] where it is cooled to substantial condensation. The resulting substantially condensed stream 35*a* at −132° F. [−91° C.] is then flash expanded through an appropriate expansion device, such as expansion valve 13, to the operating pressure (approximately 469 psia [3,234 kPa(a)]) of fractionation tower 17, cooling stream 35*b* to −134° F. [92° C.] before it is supplied to fractionation tower 17 at a mid-column feed point.

The remaining 88% of the vapor from separator 11 (stream 36) enters a work expansion machine 14 in which mechanical energy is extracted from this portion of the high pressure feed. The machine 14 expands the vapor substantially isentropically to the tower operating pressure, with the work expansion cooling the expanded stream 36*a* to a temperature of approximately −99° F. [−73° C.]. The partially condensed expanded stream 36*a* is thereafter supplied as feed to fractionation tower 17 at a second mid-column feed point.

The remaining 50% of the liquid from separator 11 (stream 38) is flash expanded through an appropriate expansion device, such as expansion valve 16, to the operating pressure of fractionation tower 17. The expansion cools stream 38*a* to −59° F. [−51° C.] before it is supplied to fractionation tower 17 at a third mid-column feed point.

The recompressed and cooled vapor stream 43*e* is divided into two streams. One portion, stream 47, is the volatile residue gas product. The other portion, recycle stream 48, flows to heat exchanger 22 where it is cooled to −1° F. [−18° C.] (stream 48*a*) by heat exchange with a portion (stream 45) of cool vapor stream 43*a*. The cooled recycle stream then flows to exchanger 12 where it is cooled to −132° F. [−91° C.] and substantially condensed by heat exchange with cold vapor stream 43. The substantially condensed stream 48*b* is then expanded through an appropriate expansion device, such as expansion valve 23, to the demethanizer operating pressure, resulting in cooling of the total stream to −140° F. [−95° C.]. The expanded stream 48*c* is then supplied to fractionation tower 17 as the top column feed. The vapor portion (if any) of stream 48*c* combines with the vapors rising from the top fractionation stage of the column to form distillation stream 39, which is withdrawn from an upper region of the tower.

The distillation vapor stream forming the tower overhead (stream 39) leaves fractionation tower 17 at −136° F. [−93° C.] and is divided into two portions, first and second vapor streams 44 and 43, respectively. First vapor stream 44 is combined with a portion of the distillation vapor (stream 49)

withdrawn from the lower region of the absorbing section of fractionation tower 17 at −128° F. [−89° C.], and the combined vapor stream 50 is compressed to an intermediate pressure of about 732 psia [5,047 kPa(a)] by reflux compressor 24. The compressed stream 50*a* flows to exchanger 12 where it is cooled to −132° F. [−91° C.] and substantially condensed by heat exchange with the remaining portion (stream 43) of cold distillation column overhead stream 39. The substantially condensed stream 50*b* is then divided into two portions, streams 51 and 52. The first portion, stream 51 containing about 90% of stream 50*b*, is expanded through an appropriate expansion device, such as expansion valve 25, to the demethanizer operating pressure, resulting in cooling of stream 51*a* to a temperature of −136° F. [−94° C.], whereupon it is supplied to fractionation tower 17 at a fourth mid-column feed point as in the FIG. 5 embodiment of the present invention. The remaining portion, stream 52 containing about 10% of stream 50*b*, is expanded through an appropriate expansion device, such as expansion valve 26, to the demethanizer operating pressure, resulting in cooling of stream 52*a* to a temperature of −136° F. [−94° C.], whereupon it is supplied to fractionation tower 17 at a fifth mid-column feed point, located below the feed point of stream 51*a*.

In the stripping section of demethanizer 17, the feed streams are stripped of their methane and lighter components. The resulting liquid product (stream 42) exits the bottom of tower 17 at 89° F. [31° C.]. Pump 19 delivers stream 42*a* to heat exchanger 10 as described previously where it is heated to 116° F. [47° C.] (stream 42*b*) before flowing to storage.

Second vapor stream 43 (the remaining portion of cold distillation column overhead stream 39) is warmed in heat exchanger 12 as it provides cooling to combined stream 35, compressed combined stream 50*a*, and recycle stream 48*a* as described previously to form cool second vapor stream 43*a*. Second vapor stream 43*a* is divided into two portions (streams 45 and 46), which are heated to 116° F. [47° C.] and 94° F. [34° C.], respectively, in heat exchanger 22 and heat exchanger 10. The heated streams recombine to form stream 43*b* at 96° F. [35° C.] which is then re-compressed in two stages, compressor 15 driven by expansion machine 14 and compressor 20 driven by a supplemental power source. After stream 43*d* is cooled to 120° F. [49° C.] in discharge cooler 21 to form stream 43*e*, recycle stream 48 is withdrawn as described earlier to form residue gas stream 47 which flows to the sales gas pipeline at 1040 psia [7,171 kPa(a)].

A summary of stream flow rates and energy consumption for the process illustrated in FIG. 6 is set forth in the following table:

TABLE VI (FIG. 6)
Stream Flow Summary - Lb. Moles/Hr [kg moles/Hr]

| Stream | Methane | Ethane | Propane | Butanes+ | Total |
|---|---|---|---|---|---|
| 31 | 25,384 | 1,161 | 362 | 332 | 27,451 |
| 32 | 25,122 | 1,109 | 319 | 191 | 26,949 |
| 33 | 262 | 52 | 43 | 141 | 502 |
| 34 | 2,977 | 131 | 38 | 23 | 3,194 |
| 37 | 131 | 26 | 21 | 70 | 251 |
| 35 | 3,108 | 157 | 59 | 93 | 3,445 |
| 36 | 22,145 | 978 | 281 | 168 | 23,755 |
| 38 | 131 | 26 | 22 | 71 | 251 |
| 39 | 29,044 | 37 | 0 | 0 | 29,260 |
| 44 | 871 | 1 | 0 | 0 | 878 |
| 49 | 4,487 | 44 | 1 | 0 | 4,575 |
| 50 | 5,358 | 45 | 1 | 0 | 5,453 |
| 51 | 4,823 | 40 | 1 | 0 | 4,908 |
| 52 | 535 | 5 | 0 | 0 | 545 |
| 43 | 28,173 | 36 | 0 | 0 | 28,382 |
| 48 | 2,817 | 4 | 0 | 0 | 2,838 |
| 47 | 25,356 | 32 | 0 | 0 | 25,544 |
| 42 | 28 | 1,129 | 362 | 332 | 1,907 |

Recoveries*

| | |
|---|---|
| Ethane | 97.22% |
| Propane | 99.99% |
| Butanes+ | 100.00% |

Power

| | | |
|---|---|---|
| Residue Gas Compression | 11,488 HP | [18,886 kW] |
| Reflux Compression | 548 HP | [901 kW] |
| Total Compression | 12,036 HP | [19,787 kW] |

*(Based on un-rounded flow rates)

A comparison of Tables III, IV, V, and VI shows that, compared to the FIGS. 3 through 5 embodiments of the present invention, the FIG. 6 embodiment maintains essentially the same ethane recovery, propane recovery, and butanes+ recovery. However, comparison of Tables III, IV, V, and VI further shows that these yields were achieved using about 2% less horsepower than that required by the FIG. 3 embodiment, and about 1% less horsepower than the FIG. 4 and FIG. 5 embodiments. The drop in the power requirements for the FIG. 6 embodiment is mainly due to the slightly higher operating pressure of fractionation tower 17, which is possible due to the better rectification in its absorbing section provided by introducing a portion of the supplemental reflux (stream 52*a*) lower in the absorbing section. This effectively reduces the concentration of $C_2$+ components in the column liquids where expanded combined stream 35*b* is introduced, thereby reducing the equilibrium concentrations of these heavier components in the vapors rising above this region of the absorbing section. The reduction in power requirements for this embodiment over that of the FIGS. 3 through 5 embodiments must be evaluated for each application relative to the slight increase in capital cost for the FIG. 6 embodiment compared to the other embodiments.

Other Embodiments

In accordance with this invention, it is generally advantageous to design the absorbing (rectification) section of the demethanizer to contain multiple theoretical separation stages. However, the benefits of the present invention can be achieved with as few as one theoretical stage, and it is believed that even the equivalent of a fractional theoretical stage may allow achieving these benefits. For instance, all or a part of the expanded substantially condensed recycle stream 48*c*, all or a part of the supplemental reflux (stream 49*c* in FIG. 3, stream 50*c* in FIG. 5, or streams 51*a* and 52*a* in FIGS. 4 and 6), all or a part of the expanded substantially condensed stream 35*b*, and all or a part of the expanded stream 36*a* can be combined (such as in the piping joining the expansion valve to the demethanizer) and if thoroughly intermingled, the vapors and liquids will mix together and separate in accordance with the relative volatilities of the various components of the total combined streams. Such commingling of the four or five streams shall be considered for the purposes of this invention as constituting an absorbing section. Specifically, commingling of supplemental reflux stream 52*a* and expanded substantially condensed stream 35*b* appears to be advantageous in many instances, as does commingling of the expanded substantially condensed recycle stream 48*c* and all or a part of the supplemental reflux (stream 49*c* in FIG. 3, stream 50*c* in FIG. 5, or stream 51*a* in FIGS. 4 and 6).

Figure 7:
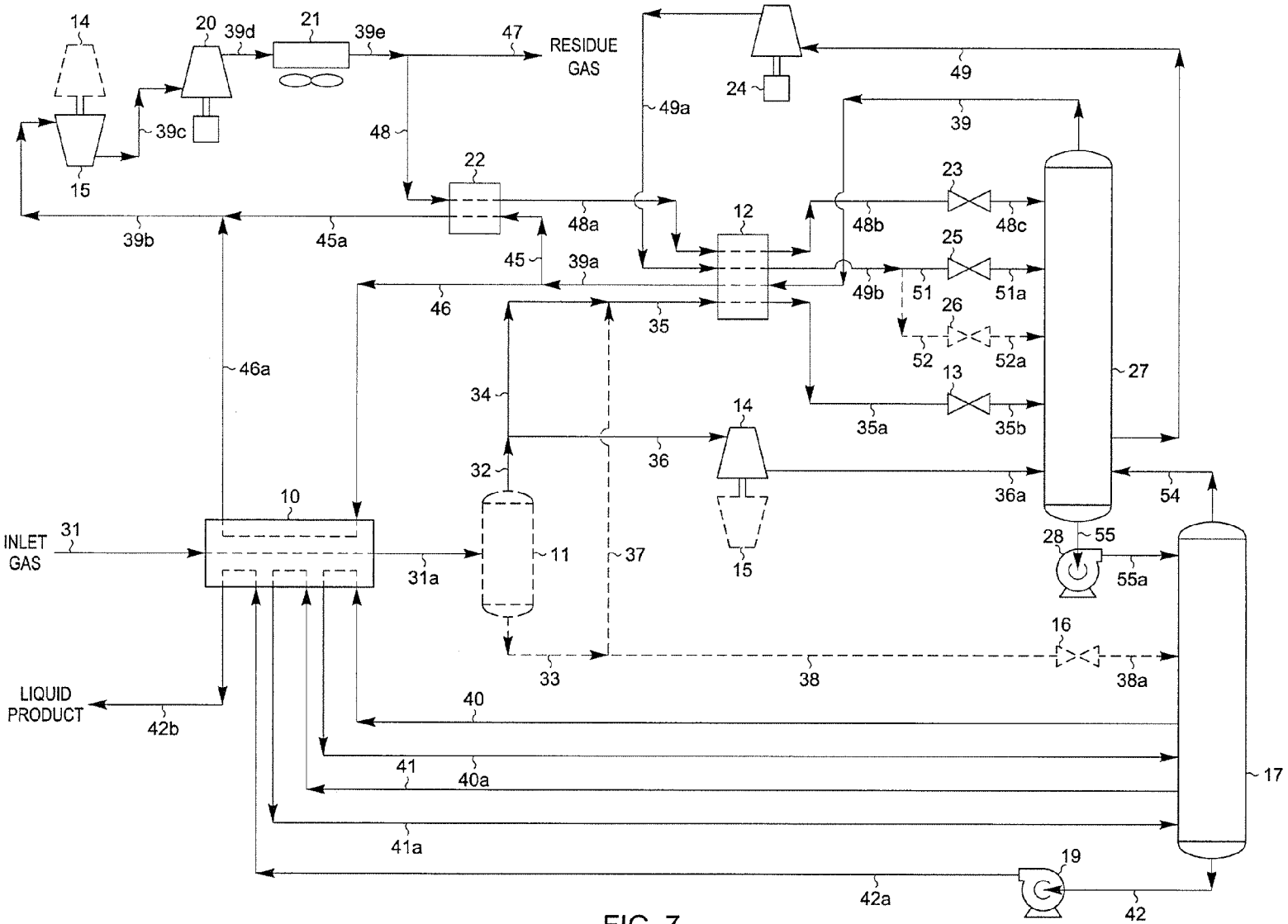
Figure 8:
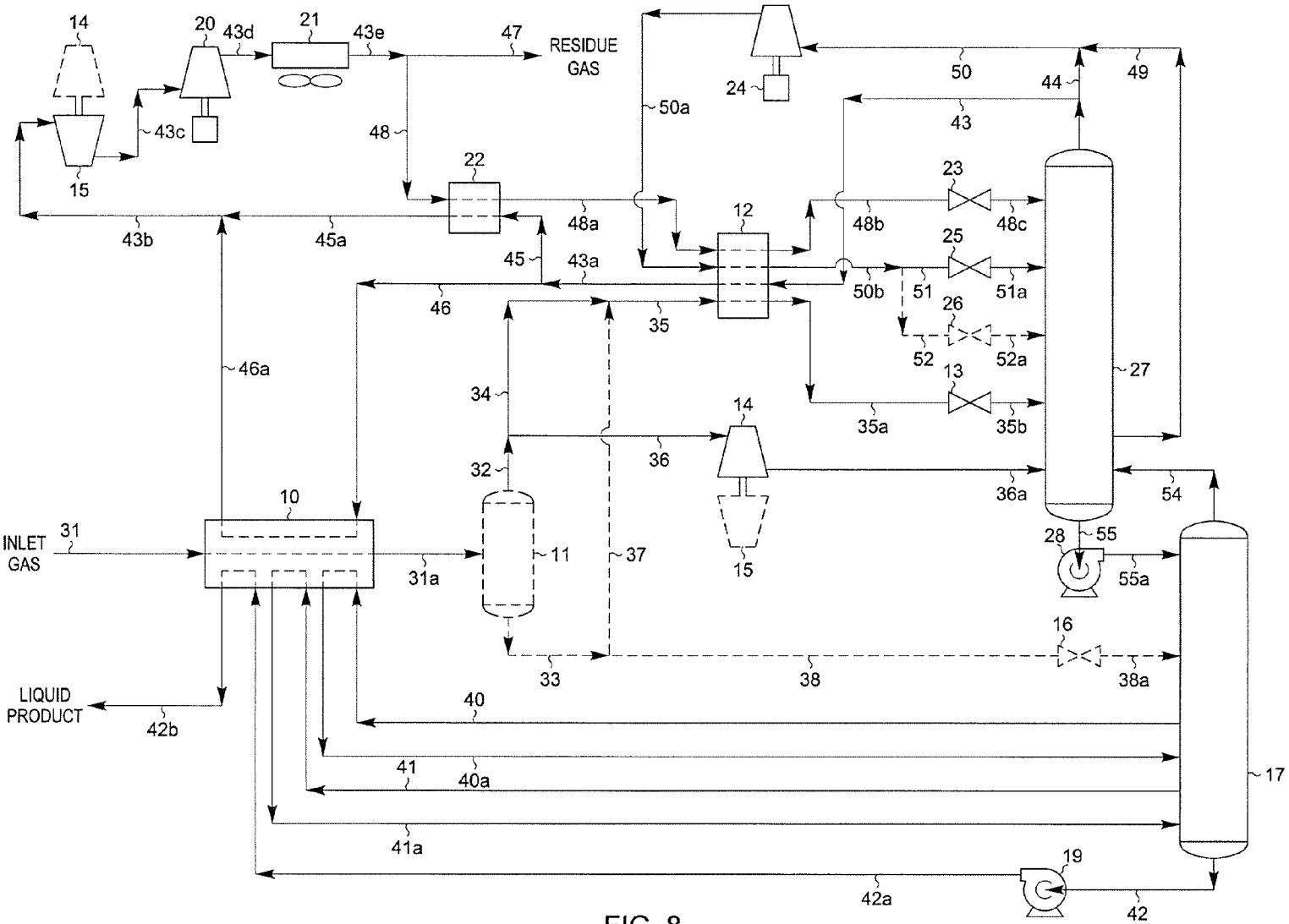

FIGS. 7 and 8 depict fractionation towers constructed in two vessels, absorber (rectifier) column 27 (a contacting and separating device) and stripper (distillation) column 17. In such cases, a portion of the distillation vapor (stream 49) is withdrawn from the lower section of absorber column 27 and routed to reflux compressor 24 (optionally, as shown in FIG. 8, combined with a portion, stream 44, of overhead distillation stream 39 from absorber column 27) to generate supplemental reflux for absorber column 27. The overhead vapor (stream 54) from stripper column 17 flows to the lower section of absorber column 27 to be contacted by expanded substantially condensed recycle stream 48*c*, supplemental reflux liquid (stream 51*a* and optional stream 52*a*), and expanded substantially condensed stream 35*b*. Pump 28 is used to route the liquids (stream 55) from the bottom of absorber column 27 to the top of stripper column 17 so that the two towers effectively function as one distillation system. The decision whether to construct the fractionation tower as a single vessel (such as demethanizer 17 in FIGS. 3 through 6) or multiple vessels will depend on a number of factors such as plant size, the distance to fabrication facilities, etc.

As described in the earlier examples, the supplemental reflux (stream 49*b* in FIGS. 3, 4, and 7 and stream 50*b* in FIGS. 5, 6, and 8) is totally condensed and the resulting condensate used to absorb valuable $C_2$ components, $C_3$ components, and heavier components from the vapors rising through the lower region of absorbing section 17*b* of demethanizer 17 (FIGS. 3 through 6) or through absorber column 27 (FIGS. 7 and 8). However, the present invention is not limited to this embodiment. It may be advantageous, for instance, to treat only a portion of these vapors in this manner, or to use only a portion of the condensate as an absorbent, in cases where other design considerations indicate portions of the vapors or the condensate should bypass absorbing section 17*b* of demethanizer 17 (FIGS. 3 through 6) or absorber column 27 (FIGS. 7 and 8). Some circumstances may favor partial condensation, rather than total condensation, of the supplemental reflux stream (49*b* or 50*b*) in heat exchanger 12. Other circumstances may favor that distillation stream 49 be a total vapor side draw from fractionation column 17 (FIGS. 3 through 6) or absorber column 27 (FIGS. 7 and 8) rather than a partial vapor side draw. It should also be noted that, depending on the composition of the feed gas stream, it may be advantageous to use external refrigeration to provide some portion of the cooling of the supplemental reflux stream (49*b* or 50*b*) in heat exchanger 12.

Feed gas conditions, plant size, available equipment, or other factors may indicate that elimination of work expansion machine 14, or replacement with an alternate expansion device (such as an expansion valve), is feasible. Although individual stream expansion is depicted in particular expansion devices, alternative expansion means may be employed where appropriate. For example, conditions may warrant work expansion of the substantially condensed recycle stream (stream 48*b*), the supplemental reflux (stream 49*b*, stream 50*b*, or streams 51 and/or 52), or the substantially condensed stream (stream 35*a*).

When the inlet gas is leaner, separator 11 in FIGS. 3 through 8 may not be needed. Depending on the quantity of heavier hydrocarbons in the feed gas and the feed gas pressure, the cooled feed stream 31*a* leaving heat exchanger 10 in FIGS. 3 through 8 may not contain any liquid (because it is above its dewpoint, or because it is above its cricondenbar), so that separator 11 shown in FIGS. 3 through 8 is not required. Additionally, even in those cases where separator 11 is required, it may not be advantageous to combine any of the resulting liquid in stream 33 with vapor stream 34. In such cases, all of the liquid would be directed to stream 38 and thence to expansion valve 16 and a lower mid-column feed point on demethanizer 17 (FIGS. 3 through 6) or a mid-column feed point on stripping column 17 (FIGS. 7 and 8). Other applications may favor combining all of the resulting liquid in stream 33 with vapor stream 34. In such cases, there would be no flow in stream 38 and expansion valve 16 would not be required.

In accordance with this invention, the use of external refrigeration to supplement the cooling available to the inlet gas and/or the recycle gas from other process streams may be employed, particularly in the case of a rich inlet gas. The use and distribution of separator liquids and demethanizer side draw liquids for process heat exchange, and the particular arrangement of heat exchangers for inlet gas cooling must be evaluated for each particular application, as well as the choice of process streams for specific heat exchange services.

It will also be recognized that the relative amount of feed found in each branch of the split vapor feed and the split liquid feed will depend on several factors, including gas pressure, feed gas composition, the amount of heat which can economically be extracted from the feed, and the quantity of horsepower available. The relative locations of the mid-column feeds and the withdrawal point of distillation vapor stream 49 may vary depending on inlet composition or other factors such as desired recovery levels and amount of liquid formed during inlet gas cooling. In some circumstances, withdrawal of distillation vapor stream 49 below the feed location of expanded stream 36*a* is favored. Moreover, two or more of the feed streams, or portions thereof, may be combined depending on the relative temperatures and quantities of individual streams, and the combined stream then fed to a mid-column feed position. The intermediate pressure to which distillation stream 49 or combined vapor stream 50 is compressed must be determined for each application, as it is a function of inlet composition, the desired recovery level, the withdrawal point of distillation vapor stream 49, and other factors.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein following cooling, said cooled stream is divided into first and second streams; and (1) said first stream is cooled to condense substantially all of it and is thereafter expanded to said lower pressure whereby it is further cooled;

(2) said expanded cooled first stream is thereafter supplied to said distillation column at a first mid-column feed position;

(3) said second stream is expanded to said lower pressure and is supplied to said distillation column at a second mid-column feed position;

(4) a distillation vapor stream is withdrawn from a region of said distillation column below said expanded cooled first stream and is compressed to an intermediate pressure;

(5) said compressed distillation vapor stream is cooled sufficiently to condense at least a part of it, thereby forming a condensed stream;

(6) at least a portion of said condensed stream is expanded to said lower pressure and is thereafter supplied to said distillation column at a third mid-column feed position located above said expanded cooled first stream;

(7) an overhead vapor stream is withdrawn from an upper region of said distillation column and at least a portion of said overhead vapor stream is directed into heat exchange relation with said compressed distillation vapor stream and heated, thereby to supply at least a portion of the cooling of step (5);

(8) said heated overhead vapor stream is compressed to higher pressure and thereafter divided into said volatile residue gas fraction and a compressed recycle stream;

(9) said compressed recycle stream is cooled sufficiently to substantially condense it;

(10) said substantially condensed compressed recycle stream is expanded to said lower pressure and supplied to said distillation column at a top feed position; and

(11) the quantities and temperatures of said feed streams to said distillation column are effective to maintain the overhead temperature of said distillation column at a temperature whereby the major portions of the components in said relatively less volatile fraction are recovered.

2. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein said gas stream is cooled sufficiently to partially condense it; and (1) said partially condensed gas stream is separated thereby to provide a vapor stream and at least one liquid stream;

(2) said vapor stream is thereafter divided into first and second streams;

(3) said first stream is cooled to condense substantially all of it and is thereafter expanded to said lower pressure whereby it is further cooled;

(4) said expanded cooled first stream is thereafter supplied to said distillation column at a first mid-column feed position;

(5) said second stream is expanded to said lower pressure and is supplied to said distillation column at a second mid-column feed position;

(6) a distillation vapor stream is withdrawn from a region of said distillation column below said expanded cooled first stream and is compressed to an intermediate pressure;

(7) said compressed distillation vapor stream is cooled sufficiently to condense at least a part of it, thereby forming a condensed stream;

(8) at least a portion of said condensed stream is expanded to said lower pressure and is thereafter supplied to said distillation column at a third mid-column feed position located above said expanded cooled first stream;

(9) at least a portion of said at least one liquid stream is expanded to said lower pressure and is supplied to said distillation column at a fourth mid-column feed position;

(10) an overhead vapor stream is withdrawn from an upper region of said distillation column and at least a portion of said overhead vapor stream is directed into heat exchange relation with said compressed distillation vapor stream and heated, thereby to supply at least a portion of the cooling of step (7);

(11) said heated overhead vapor stream is compressed to higher pressure and thereafter divided into said volatile residue gas fraction and a compressed recycle stream;

(12) said compressed recycle stream is cooled sufficiently to substantially condense it;

(13) said substantially condensed compressed recycle stream is expanded to said lower pressure and supplied to said distillation column at a top feed position; and

(14) the quantities and temperatures of said feed streams to said distillation column are effective to maintain the overhead temperature of said distillation column at a temperature whereby the major portions of the components in said relatively less volatile fraction are recovered.

3. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein said gas stream is cooled sufficiently to partially condense it; and (1) said partially condensed gas stream is separated thereby to provide a vapor stream and at least one liquid stream;

(2) said vapor stream is thereafter divided into first and second streams;

(3) said first stream is combined with at least a portion of said at least one liquid stream to form a combined stream, and said combined stream is cooled to condense substantially all of it and is thereafter expanded to said lower pressure whereby it is further cooled;

(4) said expanded cooled combined stream is thereafter supplied to said distillation column at a first mid-column feed position;

(5) said second stream is expanded to said lower pressure and is supplied to said distillation column at a second mid-column feed position;

(6) a distillation vapor stream is withdrawn from a region of said distillation column below said expanded cooled combined stream and is compressed to an intermediate pressure;

(7) said compressed distillation vapor stream is cooled sufficiently to condense at least a part of it, thereby forming a condensed stream;

(8) at least a portion of said condensed stream is expanded to said lower pressure and is thereafter supplied to said distillation column at a third mid-column feed position located above said expanded cooled combined stream;

(9) any remaining portion of said at least one liquid stream is expanded to said lower pressure and is supplied to said distillation column at a fourth mid-column feed position;

(10) an overhead vapor stream is withdrawn from an upper region of said distillation column and at least a portion of said overhead vapor stream is directed into heat exchange relation with said compressed distillation vapor stream and heated, thereby to supply at least a portion of the cooling of step (7);

(11) said heated overhead vapor stream is compressed to higher pressure and thereafter divided into said volatile residue gas fraction and a compressed recycle stream;

(12) said compressed recycle stream is cooled sufficiently to substantially condense it;

(13) said substantially condensed compressed recycle stream is expanded to said lower pressure and supplied to said distillation column at a top feed position; and

(14) the quantities and temperatures of said feed streams to said distillation column are effective to maintain the overhead temperature of said distillation column at a temperature whereby the major portions of the components in said relatively less volatile fraction are recovered.

4. The improvement according to claim 1, 2, or 3 wherein (1) said overhead vapor stream is divided into at least a first vapor stream and a second vapor stream;

(2) said first vapor stream is combined with said distillation vapor stream to form a combined vapor stream, whereupon said combined vapor stream is compressed to said intermediate pressure;

(3) said compressed combined vapor stream is cooled sufficiently to condense at least a part of it, thereby forming said condensed stream;

(4) said second vapor stream is directed into heat exchange relation with said compressed combined stream and heated, thereby to supply at least a portion of the cooling of step (3); and (5) said heated second vapor stream is compressed to said higher pressure and thereafter divided into said volatile residue gas fraction and said compressed recycle stream.

5. The improvement according to claim 4 wherein (1) said condensed stream is divided into at least a first portion and a second portion;

(2) said first portion is expanded to said lower pressure and is thereafter supplied to said distillation column at said third mid-column feed position; and (3) said second portion is expanded to said lower pressure and is thereafter supplied to said distillation column at a mid-column feed position below that of said expanded first portion.

6. The improvement according to claim 1, 2, or 3 wherein (1) said condensed stream is divided into at least a first portion and a second portion;

(2) said first portion is expanded to said lower pressure and is thereafter supplied to said distillation column at said third mid-column feed position; and (3) said second portion is expanded to said lower pressure and is thereafter supplied to said distillation column at a mid-column feed position below that of said expanded first portion.

7. The improvement according to claim 1, 2, or 3 wherein said at least a portion of said expanded condensed stream is combined with said expanded substantially condensed compressed recycle stream to form a combined condensed stream, whereupon said combined condensed stream is supplied to said distillation column at said top feed position.

8. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein following cooling, said cooled stream is divided into first and second streams; and (1) said first stream is cooled to condense substantially all of it and is thereafter expanded to said lower pressure whereby it is further cooled;

(2) said expanded cooled first stream is thereafter supplied at a first mid-column feed position to a contacting and separating device that produces a first overhead vapor stream and a bottom liquid stream, whereupon said bottom liquid stream is supplied to said distillation column;

(3) a second overhead vapor stream is withdrawn from an upper region of said distillation column and is directed to said contacting and separating device at a first lower feed position;

(4) said second stream is expanded to said lower pressure and is supplied to said contacting and separating device at a second lower feed position;

(5) a distillation vapor stream is withdrawn from a region of said contacting and separating device below said expanded cooled first stream and is compressed to an intermediate pressure;

(6) said compressed distillation vapor stream is cooled sufficiently to condense at least a part of it, thereby forming a condensed stream;

(7) at least a portion of said condensed stream is expanded to said lower pressure and is thereafter supplied to said contacting and separating device at a second mid-column feed position located above said expanded cooled first stream;

(8) at least a portion of said first overhead vapor stream is directed into heat exchange relation with said compressed distillation vapor stream and heated, thereby to supply at least a portion of the cooling of step (6);

(9) said heated first overhead vapor stream is compressed to higher pressure and thereafter divided into said volatile residue gas fraction and a compressed recycle stream;

(10) said compressed recycle stream is cooled sufficiently to substantially condense it;

(11) said substantially condensed compressed recycle stream is expanded to said lower pressure and supplied to said contacting and separating device at a top feed position; and

(12) the quantities and temperatures of said feed streams to said contacting and separating device are effective to maintain the overhead temperature of said contacting and separating device at a temperature whereby the major portions of the components in said relatively less volatile fraction are recovered.

9. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein said gas stream is cooled sufficiently to partially condense it; and (1) said partially condensed gas stream is separated thereby to provide a vapor stream and at least one liquid stream;

(2) said vapor stream is thereafter divided into first and second streams;

(3) said first stream is cooled to condense substantially all of it and is thereafter expanded to said lower pressure whereby it is further cooled;

(4) said expanded cooled first stream is thereafter supplied at a first mid-column feed position to a contacting and separating device that produces a first overhead vapor stream and a bottom liquid stream, whereupon said bottom liquid stream is supplied to said distillation column;

(5) a second overhead vapor stream is withdrawn from an upper region of said distillation column and is directed to said contacting and separating device at a first lower feed position;

(6) said second stream is expanded to said lower pressure and is supplied to said contacting and separating device at a second lower feed position;

(7) a distillation vapor stream is withdrawn from a region of said contacting and separating device below said expanded cooled first stream and is compressed to an intermediate pressure;

(8) said compressed distillation vapor stream is cooled sufficiently to condense at least a part of it, thereby forming a condensed stream;

(9) at least a portion of said condensed stream is expanded to said lower pressure and is thereafter supplied to said contacting and separating device at a second mid-column feed position located above said expanded cooled first stream;

(10) at least a portion of said at least one liquid stream is expanded to said lower pressure and is supplied to said distillation column at a mid-column feed position;

(11) at least a portion of said first overhead vapor stream is directed into heat exchange relation with said compressed distillation vapor stream and heated, thereby to supply at least a portion of the cooling of step (8);

(12) said heated first overhead vapor stream is compressed to higher pressure and thereafter divided into said volatile residue gas fraction and a compressed recycle stream;

(13) said compressed recycle stream is cooled sufficiently to substantially condense it;

(14) said substantially condensed compressed recycle stream is expanded to said lower pressure and supplied to said contacting and separating device at a top feed position; and

(15) the quantities and temperatures of said feed streams to said contacting and separating device are effective to maintain the overhead temperature of said contacting and separating device at a temperature whereby the major portions of the components in said relatively less volatile fraction are recovered.

10. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is cooled under pressure to provide a cooled stream;

(b) said cooled stream is expanded to a lower pressure whereby it is further cooled; and (c) said further cooled stream is directed into a distillation column and fractionated at said lower pressure whereby the components of said relatively less volatile fraction are recovered;

the improvement wherein said gas stream is cooled sufficiently to partially condense it; and (1) said partially condensed gas stream is separated thereby to provide a vapor stream and at least one liquid stream;

(2) said vapor stream is thereafter divided into first and second streams;

(3) said first stream is combined with at least a portion of said at least one liquid stream to form a combined stream, and said combined stream is cooled to condense substantially all of it and is thereafter expanded to said lower pressure whereby it is further cooled;

(4) said expanded cooled combined stream is thereafter supplied at a first mid-column feed position to a contacting and separating device that produces a first overhead vapor stream and a bottom liquid stream, whereupon said bottom liquid stream is supplied to said distillation column;

(5) a second overhead vapor stream is withdrawn from an upper region of said distillation column and is directed to said contacting and separating device at a first lower feed position;

(6) said second stream is expanded to said lower pressure and is supplied to said contacting and separating device at a second lower feed position;

(7) a distillation vapor stream is withdrawn from a region of said contacting and separating device below said expanded cooled combined stream and is compressed to an intermediate pressure;

(8) said compressed distillation vapor stream is cooled sufficiently to condense at least a part of it, thereby forming a condensed stream;

(9) at least a portion of said condensed stream is expanded to said lower pressure and is thereafter supplied to said contacting and separating device at a second mid-column feed position located above said expanded cooled combined stream;

(10) any remaining portion of said at least one liquid stream is expanded to said lower pressure and is supplied to said distillation column at a mid-column feed position;

(11) at least a portion of said first overhead vapor stream is directed into heat exchange relation with said compressed distillation vapor stream and heated, thereby to supply at least a portion of the cooling of step (8);

(12) said heated first overhead vapor stream is compressed to higher pressure and thereafter divided into said volatile residue gas fraction and a compressed recycle stream;

(13) said compressed recycle stream is cooled sufficiently to substantially condense it;

(14) said substantially condensed compressed recycle stream is expanded to said lower pressure and supplied to said contacting and separating device at a top feed position; and

(15) the quantities and temperatures of said feed streams to said contacting and separating device are effective to maintain the overhead temperature of said contacting and separating device at a temperature whereby the major portions of the components in said relatively less volatile fraction are recovered.

11. The improvement according to claim 8, 9, or 10 wherein (1) said first overhead vapor stream is divided into at least a first vapor stream and a second vapor stream;

(2) said first vapor stream is combined with said distillation vapor stream to form a combined vapor stream, whereupon said combined vapor stream is compressed to said intermediate pressure;

(3) said compressed combined vapor stream is cooled sufficiently to condense at least a part of it, thereby forming said condensed stream;

(4) said second vapor stream is directed into heat exchange relation with said compressed combined stream and heated, thereby to supply at least a portion of the cooling of step (3); and (5) said heated second vapor stream is compressed to said higher pressure and thereafter divided into said volatile residue gas fraction and said compressed recycle stream.

12. The improvement according to claim 11 wherein (1) said condensed stream is divided into at least a first portion and a second portion;

(2) said first portion is expanded to said lower pressure and is thereafter supplied to said contacting and separating device at said second mid-column feed position; and (3) said second portion is expanded to said lower pressure and is thereafter supplied to said contacting and separating device at a mid-column feed position below that of said expanded first portion.

13. The improvement according to claim 8, 9, or 10 wherein (1) said condensed stream is divided into at least a first portion and a second portion;

(2) said first portion is expanded to said lower pressure and is thereafter supplied to said contacting and separating device at said second mid-column feed position; and (3) said second portion is expanded to said lower pressure and is thereafter supplied to said contacting and separating device at a mid-column feed position below that of said expanded first portion.

14. The improvement according to claim 8, 9, or 10 wherein said at least a portion of said expanded condensed stream is combined with said expanded substantially condensed compressed recycle stream to form a combined condensed stream, whereupon said combined condensed stream is supplied to said contacting and separating device at said top feed position.

15. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into an overhead vapor stream and said relatively less volatile fraction;

the improvement wherein said apparatus includes (1) first dividing means connected to said first cooling means to receive said cooled stream and to divide it into first and second streams;

(2) second cooling means connected to said first dividing means to receive said first stream and to cool it sufficiently to substantially condense it;

(3) said first expansion means being connected to said second cooling means to receive said substantially condensed first stream and to expand it to said lower pressure, said first expansion means being further connected to said distillation column to supply said expanded cooled first stream to said distillation column at a first mid-column feed position;

(4) second expansion means connected to said first dividing means to receive said second stream and to expand it to said lower pressure, said second expansion means being further connected to said distillation column to supply said expanded second stream to said distillation column at a second mid-column feed position;

(5) vapor withdrawing means connected to said distillation column to receive a distillation vapor stream from a region of said distillation column below said expanded cooled first stream;

(6) first compressing means connected to said vapor withdrawing means to receive said distillation vapor stream and to compress it to an intermediate pressure;

(7) heat exchange means connected to said first compressing means to receive said compressed distillation vapor stream and to cool it sufficiently to condense at least a part of it, thereby forming a condensed stream;

(8) third expansion means connected to said heat exchange means to receive at least a portion of said condensed stream and to expand it to said lower pressure, said third expansion means being further connected to said distillation column to supply said at least a portion of said expanded condensed stream to said distillation column at a third mid-column feed position located above said expanded cooled first stream;

(9) said distillation column being further connected to said heat exchange means to direct at least a portion of said overhead vapor stream separated therein into heat exchange relation with said compressed distillation vapor stream and to heat said overhead vapor stream, thereby to supply at least a portion of the cooling of step (7);

(10) second compressing means connected to said heat exchange means to receive said heated overhead vapor stream and compress it to higher pressure;

(11) second dividing means connected to said second compressing means to receive said compressed heated overhead vapor stream and divide it into said volatile residue gas fraction and a compressed recycle stream;

(12) third cooling means connected to said second dividing means to receive said compressed recycle stream and cool it sufficiently to substantially condense it;

(13) fourth expansion means connected to said third cooling means to receive said substantially condensed compressed recycle stream and expand it to said lower pressure, said fourth expansion means being further connected to said distillation column to supply said expanded condensed recycle stream to said distillation column at a top feed position; and

(14) control means adapted to regulate the quantities and temperatures of said feed streams to said distillation column to maintain the overhead temperature of said distillation column at a temperature whereby the major portions of the components in said relatively less volatile fraction are recovered.

16. The improvement according to claim 15 wherein (1) a third dividing means is connected to said distillation column to receive said overhead vapor stream and divide it into at least a first vapor stream and a second vapor stream;

(2) a combining means is connected to said third dividing means and said vapor withdrawing means to receive said first vapor stream and said distillation vapor stream and form a combined vapor stream;

(3) said first compressing means is adapted to be connected to said combining means to receive said combined vapor stream and compress it to said intermediate pressure;

(4) said heat exchange means is adapted to receive said compressed combined vapor stream and cool it sufficiently to condense at least a part of it, thereby forming said condensed stream;

(5) said heat exchange means is further adapted to be connected to said third dividing means to receive said second vapor stream and direct it into heat exchange relation with said compressed combined vapor stream and to heat said second vapor stream, thereby to supply at least a portion of the cooling of step (4);

(6) said second compressing means is adapted to receive said heated second vapor stream and compress it to said higher pressure; and (7) said second dividing means is adapted to receive said compressed heated second vapor stream and divide it into said volatile residue gas fraction and said compressed recycle stream.

17. The improvement according to claim 16 wherein (1) a fourth dividing means is connected to said heat exchange means to receive said condensed stream and divide it into at least a first portion and a second portion;

(2) said third expansion means is adapted to be connected to said fourth dividing means to receive said first portion and expand it to said lower pressure, said third expansion means being further connected to said distillation column to supply said expanded first portion to said distillation column at said third mid-column feed position; and (3) a fifth expansion means is connected to said fourth dividing means to receive said second portion and expand it to said lower pressure, said fifth expansion means being further connected to said distillation column to supply said expanded second portion to said distillation column at a mid-column feed position below that of said expanded first portion.

18. The improvement according to claim 15 wherein (1) a third dividing means is connected to said heat exchange means to receive said condensed stream and divide it into at least a first portion and a second portion;

(2) said third expansion means is adapted to be connected to said third dividing means to receive said first portion and expand it to said lower pressure, said third expansion means being further connected to said distillation column to supply said expanded first portion to said distillation column at said third mid-column feed position; and (3) a fifth expansion means is connected to said third dividing means to receive said second portion and expand it to said lower pressure, said fifth expansion means being further connected to said distillation column to supply said expanded second portion to said distillation column at a mid-column feed position below that of said expanded first portion.

19. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into an overhead vapor stream and said relatively less volatile fraction;

the improvement wherein said apparatus includes (1) said first cooling means being adapted to cool said feed gas under pressure sufficiently to partially condense it;

(2) separating means connected to said first cooling means to receive said partially condensed feed and to separate it into a vapor stream and at least one liquid stream;

(3) first dividing means connected to said separating means to receive said vapor stream and to divide it into first and second streams;

(4) second cooling means connected to said first dividing means to receive said first stream and to cool it sufficiently to substantially condense it;

(5) said first expansion means being connected to said second cooling means to receive said substantially condensed first stream and to expand it to said lower pressure, said first expansion means being further connected to said distillation column to supply said expanded cooled first stream to said distillation column at a first mid-column feed position;

(6) second expansion means connected to said first dividing means to receive said second stream and to expand it to said lower pressure, said second expansion means being further connected to said distillation column to supply said expanded second stream to said distillation column at a second mid-column feed position;

(7) vapor withdrawing means connected to said distillation column to receive a distillation vapor stream from a region of said distillation column below said expanded cooled first stream;

(8) first compressing means connected to said vapor withdrawing means to receive said distillation vapor stream and to compress it to an intermediate pressure;

(9) heat exchange means connected to said first compressing means to receive said compressed distillation vapor stream and to cool it sufficiently to condense at least a part of it, thereby forming a condensed stream;

(10) third expansion means connected to said heat exchange means to receive at least a portion of said condensed stream and to expand it to said lower pressure, said third expansion means being further connected to said distillation column to supply said at least a portion of said expanded condensed stream to said distillation column at a third mid-column feed position located above said expanded cooled first stream;

(11) fourth expansion means connected to said separating means to receive at least a portion of said at least one liquid stream and to expand it to said lower pressure, said fourth expansion means being further connected to said distillation column to supply said expanded liquid stream to said distillation column at a fourth mid-column feed position;

(12) said distillation column being further connected to said heat exchange means to direct at least a portion of said overhead vapor stream separated therein into heat exchange relation with said compressed distillation vapor stream and to heat said overhead vapor stream, thereby to supply at least a portion of the cooling of step (9);

(13) second compressing means connected to said heat exchange means to receive said heated overhead vapor stream and compress it to higher pressure;

(14) second dividing means connected to said second compressing means to receive said compressed heated overhead vapor stream and divide it into said volatile residue gas fraction and a compressed recycle stream;

(15) third cooling means connected to said second dividing means to receive said compressed recycle stream and cool it sufficiently to substantially condense it;

(16) fifth expansion means connected to said third cooling means to receive said substantially condensed compressed recycle stream and expand it to said lower pressure, said fifth expansion means being further connected to said distillation column to supply said expanded condensed recycle stream to said distillation column at a top feed position; and

(17) control means adapted to regulate the quantities and temperatures of said feed streams to said distillation column to maintain the overhead temperature of said distillation column at a temperature whereby the major portions of the components in said relatively less volatile fraction are recovered.

20. The improvement according to claim 19 wherein (1) a third dividing means is connected to said distillation column to receive said overhead vapor stream and divide it into at least a first vapor stream and a second vapor stream;

(2) a combining means is connected to said third dividing means and said vapor withdrawing means to receive said first vapor stream and said distillation vapor stream and form a combined vapor stream;

(3) said first compressing means is adapted to be connected to said combining means to receive said combined vapor stream and compress it to said intermediate pressure;

(4) said heat exchange means is adapted to receive said compressed combined vapor stream and cool it sufficiently to condense at least a part of it, thereby forming said condensed stream;

(5) said heat exchange means is further adapted to be connected to said third dividing means to receive said second vapor stream and direct it into heat exchange relation with said compressed combined vapor stream and to heat said second vapor stream, thereby to supply at least a portion of the cooling of step (4);

(6) said second compressing means is adapted to receive said heated second vapor stream and compress it to said higher pressure; and (7) said second dividing means is adapted to receive said compressed heated second vapor stream and divide it into said volatile residue gas fraction and said compressed recycle stream.

21. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into an overhead vapor stream and said relatively less volatile fraction;

the improvement wherein said apparatus includes (1) said first cooling means being adapted to cool said feed gas under pressure sufficiently to partially condense it;

(2) separating means connected to said first cooling means to receive said partially condensed feed and to separate it into a vapor stream and at least one liquid stream;

(3) first dividing means connected to said separating means to receive said vapor stream and to divide it into first and second streams;

(4) combining means connected to said first dividing means and said separating means to receive said first stream and at least a portion of said at least one liquid stream and form a combined stream;

(5) second cooling means connected to said combining means to receive said combined stream and to cool it sufficiently to substantially condense it;

(6) said first expansion means being connected to said second cooling means to receive said substantially condensed combined stream and to expand it to said lower pressure, said first expansion means being further connected to said distillation column to supply said expanded cooled combined stream to said distillation column at a first mid-column feed position;

(7) second expansion means connected to said first dividing means to receive said second stream and to expand it to said lower pressure, said second expansion means being further connected to said distillation column to supply said expanded second stream to said distillation column at a second mid-column feed position;

(8) vapor withdrawing means connected to said distillation column to receive a distillation vapor stream from a region of said distillation column below said expanded cooled combined stream;

(9) first compressing means connected to said vapor withdrawing means to receive said distillation vapor stream and to compress it to an intermediate pressure;

(10) heat exchange means connected to said first compressing means to receive said compressed distillation vapor stream and to cool it sufficiently to condense at least a part of it, thereby forming a condensed stream;

(11) third expansion means connected to said heat exchange means to receive at least a portion of said condensed stream and to expand it to said lower pressure, said third expansion means being further connected to said distillation column to supply said at least a portion of said expanded condensed stream to said distillation column at a third mid-column feed position located above said expanded cooled combined stream;

(12) fourth expansion means connected to said separating means to receive any remaining portion of said at least one liquid stream and to expand it to said lower pressure, said fourth expansion means being further connected to said distillation column to supply said expanded liquid stream to said distillation column at a fourth mid-column feed position;

(13) said distillation column being further connected to said heat exchange means to direct at least a portion of said overhead vapor stream separated therein into heat exchange relation with said compressed distillation vapor stream and to heat said overhead vapor stream, thereby to supply at least a portion of the cooling of step (10);

(14) second compressing means connected to said heat exchange means to receive said heated overhead vapor stream and compress it to higher pressure;

(15) second dividing means connected to said second compressing means to receive said compressed heated overhead vapor stream and divide it into said volatile residue gas fraction and a compressed recycle stream;

(16) third cooling means connected to said second dividing means to receive said compressed recycle stream and cool it sufficiently to substantially condense it;

(17) fifth expansion means connected to said third cooling means to receive said substantially condensed compressed recycle stream and expand it to said lower pressure, said fifth expansion means being further connected to said distillation column to supply said expanded condensed recycle stream to said distillation column at a top feed position; and

(18) control means adapted to regulate the quantities and temperatures of said feed streams to said distillation column to maintain the overhead temperature of said distillation column at a temperature whereby the major portions of the components in said relatively less volatile fraction are recovered.

22. The improvement according to claim 21 wherein (1) a third dividing means is connected to said distillation column to receive said overhead vapor stream and divide it into at least a first vapor stream and a second vapor stream;

(2) a second combining means is connected to said third dividing means and said vapor withdrawing means to receive said first vapor stream and said distillation vapor stream and form a combined vapor stream;

(3) said first compressing means is adapted to be connected to said second combining means to receive said combined vapor stream and compress it to said intermediate pressure;

(4) said heat exchange means is adapted to receive said compressed combined vapor stream and cool it sufficiently to condense at least a part of it, thereby forming said condensed stream;

(5) said heat exchange means is further adapted to be connected to said third dividing means to receive said second vapor stream and direct it into heat exchange relation with said compressed combined vapor stream and to heat said second vapor stream, thereby to supply at least a portion of the cooling of step (4);

(6) said second compressing means is adapted to receive said heated second vapor stream and compress it to said higher pressure; and (7) said second dividing means is adapted to receive said compressed heated second vapor stream and divide it into said volatile residue gas fraction and said compressed recycle stream.

23. The improvement according to claim 20 or 22 wherein (1) a fourth dividing means is connected to said heat exchange means to receive said condensed stream and divide it into at least a first portion and a second portion;

(2) said third expansion means is adapted to be connected to said fourth dividing means to receive said first portion and expand it to said lower pressure, said third expansion means being further connected to said distillation column to supply said expanded first portion to said distillation column at said third mid-column feed position; and (3) a sixth expansion means is connected to said fourth dividing means to receive said second portion and expand it to said lower pressure, said sixth expansion means being further connected to said distillation column to supply said expanded second portion to said distillation column at a mid-column feed position below that of said expanded first portion.

24. The improvement according to claim 19 or 21 wherein (1) a third dividing means is connected to said heat exchange means to receive said condensed stream and divide it into at least a first portion and a second portion;

(2) said third expansion means is adapted to be connected to said third dividing means to receive said first portion and expand it to said lower pressure, said third expansion means being further connected to said distillation column to supply said expanded first portion to said distillation column at said third mid-column feed position; and (3) a sixth expansion means is connected to said third dividing means to receive said second portion and expand it to said lower pressure, said sixth expansion means being further connected to said distillation column to supply said expanded second portion to said distillation column at a mid-column feed position below that of said expanded first portion.

25. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into a first overhead vapor stream and said relatively less volatile fraction;

the improvement wherein said apparatus includes (1) first dividing means connected to said first cooling means to receive said cooled stream and to divide it into first and second streams;

(2) second cooling means connected to said first dividing means to receive said first stream and to cool it sufficiently to substantially condense it;

(3) said first expansion means being connected to said second cooling means to receive said substantially condensed first stream and to expand it to said lower pressure, said first expansion means being further connected to a contacting and separating means to supply said expanded cooled first stream to said contacting and separating means at a first mid-column feed position, said contacting and separating means being adapted to produce a second overhead vapor stream and a bottom liquid stream;

(4) said distillation column being connected to said contacting and separating means to receive at least a portion of said bottom liquid stream, said distillation column being further connected to said contacting and separating means to direct said first overhead vapor stream separated therein to said contacting and separating means at a first lower feed position;

(5) second expansion means connected to said first dividing means to receive said second stream and to expand it to said lower pressure, said second expansion means being further connected to said contacting and separating means to supply said expanded second stream to said contacting and separating means at a second lower feed position;

(6) vapor withdrawing means connected to said contacting and separating means to receive a distillation vapor stream from a region of said contacting and separating means below said expanded cooled first stream;

(7) first compressing means connected to said vapor withdrawing means to receive said distillation vapor stream and to compress it to an intermediate pressure;

(8) heat exchange means connected to said first compressing means to receive said compressed distillation vapor stream and to cool it sufficiently to condense at least a part of it, thereby forming a condensed stream;

(9) third expansion means connected to said heat exchange means to receive at least a portion of said condensed stream and to expand it to said lower pressure, said third expansion means being further connected to said contacting and separating means to supply said at least a portion of said expanded condensed stream to said contacting and separating means at a second mid-column feed position located above said expanded cooled first stream;

(10) said contacting and separating means being further connected to said heat exchange means to direct at least a portion of said second overhead vapor stream separated therein into heat exchange relation with said compressed distillation vapor stream and to heat said second overhead vapor stream, thereby to supply at least a portion of the cooling of step (8);

(11) second compressing means connected to said heat exchange means to receive said heated second overhead vapor stream and compress it to higher pressure;

(12) second dividing means connected to said second compressing means to receive said compressed heated second overhead vapor stream and divide it into said volatile residue gas fraction and a compressed recycle stream;

(13) third cooling means connected to said second dividing means to receive said compressed recycle stream and cool it sufficiently to substantially condense it;

(14) fourth expansion means connected to said third cooling means to receive said substantially condensed compressed recycle stream and expand it to said lower pressure, said fourth expansion means being further connected to said contacting and separating means to supply said expanded condensed recycle stream to said contacting and separating means at a top feed position; and

(15) control means adapted to regulate the quantities and temperatures of said feed streams to said contacting and separating means to maintain the overhead temperature of said contacting and separating means at a temperature whereby the major portions of the components in said relatively less volatile fraction are recovered.

26. The improvement according to claim 25 wherein (1) a third dividing means is connected to said contacting and separating means to receive said second overhead vapor stream and divide it into at least a first vapor stream and a second vapor stream;

(2) a combining means is connected to said third dividing means and said vapor withdrawing means to receive said first vapor stream and said distillation vapor stream and form a combined vapor stream;

(3) said first compressing means is adapted to be connected to said combining means to receive said combined vapor stream and compress it to said intermediate pressure;

(4) said heat exchange means is adapted to receive said compressed combined vapor stream and cool it sufficiently to condense at least a part of it, thereby forming said condensed stream;

(5) said heat exchange means is further adapted to be connected to said third dividing means to receive said second vapor stream and direct it into heat exchange relation with said compressed combined vapor stream and to heat said second vapor stream, thereby to supply at least a portion of the cooling of step (4);

(6) said second compressing means is adapted to receive said heated second vapor stream and compress it to said higher pressure; and (7) said second dividing means is adapted to receive said compressed heated second vapor stream and divide it into said volatile residue gas fraction and said compressed recycle stream.

27. The improvement according to claim 26 wherein (1) a fourth dividing means is connected to said heat exchange means to receive said condensed stream and divide it into at least a first portion and a second portion;

(2) said third expansion means is adapted to be connected to said fourth dividing means to receive said first portion and expand it to said lower pressure, said third expansion means being further connected to said contacting and separating means to supply said expanded first portion to said contacting and separating means at said second mid-column feed position; and (3) a fifth expansion means is connected to said fourth dividing means to receive said second portion and expand it to said lower pressure, said fifth expansion means being further connected to said contacting and separating means to supply said expanded second portion to said contacting and separating means at a mid-column feed position below that of said expanded first portion.

28. The improvement according to claim 25 wherein (1) a third dividing means is connected to said heat exchange means to receive said condensed stream and divide it into at least a first portion and a second portion;

(2) said third expansion means is adapted to be connected to said third dividing means to receive said first portion and expand it to said lower pressure, said third expansion means being further connected to said contacting and separating means to supply said expanded first portion to said contacting and separating means at said second mid-column feed position; and (3) a fifth expansion means is connected to said third dividing means to receive said second portion and expand it to said lower pressure, said fifth expansion means being further connected to said contacting and separating means to supply said expanded second portion to said contacting and separating means at a mid-column feed position below that of said expanded first portion.

29. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into a first overhead vapor stream and said relatively less volatile fraction;

the improvement wherein said apparatus includes (1) said first cooling means being adapted to cool said feed gas under pressure sufficiently to partially condense it;

(2) separating means connected to said first cooling means to receive said partially condensed feed and to separate it into a vapor stream and at least one liquid stream;

(3) first dividing means connected to said separating means to receive said vapor stream and to divide it into first and second streams;

(4) second cooling means connected to said first dividing means to receive said first stream and to cool it sufficiently to substantially condense it;

(5) said first expansion means being connected to said second cooling means to receive said substantially condensed first stream and to expand it to said lower pressure, said first expansion means being further connected to a contacting and separating means to supply said expanded cooled first stream to said contacting and separating means at a first mid-column feed position, said contacting and separating means being adapted to produce a second overhead vapor stream and a bottom liquid stream;

(6) said distillation column being connected to said contacting and separating means to receive at least a portion of said bottom liquid stream, said distillation column being further connected to said contacting and separating means to direct said first overhead vapor stream separated therein to said contacting and separating means at a first lower feed position;

(7) second expansion means connected to said first dividing means to receive said second stream and to expand it to said lower pressure, said second expansion means being further connected to said contacting and separating means to supply said expanded second stream to said contacting and separating means at a second lower feed position;

(8) vapor withdrawing means connected to said contacting and separating means to receive a distillation vapor stream from a region of said contacting and separating means below said expanded cooled first stream;

(9) first compressing means connected to said vapor withdrawing means to receive said distillation vapor stream and to compress it to an intermediate pressure;

(10) heat exchange means connected to said first compressing means to receive said compressed distillation vapor stream and to cool it sufficiently to condense at least a part of it, thereby forming a condensed stream;

(11) third expansion means connected to said heat exchange means to receive at least a portion of said condensed stream and to expand it to said lower pressure, said third expansion means being further connected to said contacting and separating means to supply said at least a portion of said expanded condensed stream to said contacting and separating means at a second mid-column feed position located above said expanded cooled first stream;

(12) fourth expansion means connected to said separating means to receive at least a portion of said at least one liquid stream and to expand it to said lower pressure, said fourth expansion means being further connected to said distillation column to supply said expanded liquid stream to said distillation column at a mid-column feed position;

(13) said contacting and separating means being further connected to said heat exchange means to direct at least a portion of said second overhead vapor stream separated therein into heat exchange relation with said compressed distillation vapor stream and to heat said second overhead vapor stream, thereby to supply at least a portion of the cooling of step (10);

(14) second compressing means connected to said heat exchange means to receive said heated second overhead vapor stream and compress it to higher pressure;

(15) second dividing means connected to said second compressing means to receive said compressed heated second overhead vapor stream and divide it into said volatile residue gas fraction and a compressed recycle stream;

(16) third cooling means connected to said second dividing means to receive said compressed recycle stream and cool it sufficiently to substantially condense it;

(17) fifth expansion means connected to said third cooling means to receive said substantially condensed compressed recycle stream and expand it to said lower pressure, said fifth expansion means being further connected to said contacting and separating means to supply said expanded condensed recycle stream to said contacting and separating means at a top feed position; and

(18) control means adapted to regulate the quantities and temperatures of said feed streams to said contacting and separating means to maintain the overhead temperature of said contacting and separating means at a temperature whereby the major portions of the components in said relatively less volatile fraction are recovered.

30. The improvement according to claim 29 wherein (1) a third dividing means is connected to said contacting and separating means to receive said second overhead vapor stream and divide it into at least a first vapor stream and a second vapor stream;

(2) a combining means is connected to said third dividing means and said vapor withdrawing means to receive said first vapor stream and said distillation vapor stream and form a combined vapor stream;

(3) said first compressing means is adapted to be connected to said combining means to receive said combined vapor stream and compress it to said intermediate pressure;

(4) said heat exchange means is adapted to receive said compressed combined vapor stream and cool it sufficiently to condense at least a part of it, thereby forming said condensed stream;

(5) said heat exchange means is further adapted to be connected to said third dividing means to receive said second vapor stream and direct it into heat exchange relation with said compressed combined vapor stream and to heat said second vapor stream, thereby to supply at least a portion of the cooling of step (4);

(6) said second compressing means is adapted to receive said heated second vapor stream and compress it to said higher pressure; and (7) said second dividing means is adapted to receive said compressed heated second vapor stream and divide it into said volatile residue gas fraction and said compressed recycle stream.

31. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) a first cooling means to cool said gas under pressure connected to provide a cooled stream under pressure;

(b) a first expansion means connected to receive at least a portion of said cooled stream under pressure and to expand it to a lower pressure, whereby said stream is further cooled; and (c) a distillation column connected to receive said further cooled stream, said distillation column being adapted to separate said further cooled stream into a first overhead vapor stream and said relatively less volatile fraction;

the improvement wherein said apparatus includes (1) said first cooling means being adapted to cool said feed gas under pressure sufficiently to partially condense it;

(2) separating means connected to said first cooling means to receive said partially condensed feed and to separate it into a vapor stream and at least one liquid stream;

(3) first dividing means connected to said separating means to receive said vapor stream and to divide it into first and second streams;

(4) combining means connected to said first dividing means and said separating means to receive said first stream and at least a portion of said at least one liquid stream and form a combined stream;

(5) second cooling means connected to said combining means to receive said combined stream and to cool it sufficiently to substantially condense it;

(6) said first expansion means being connected to said second cooling means to receive said substantially condensed combined stream and to expand it to said lower pressure, said first expansion means being further connected to a contacting and separating means to supply said expanded cooled combined stream to said contacting and separating means at a first mid-column feed position, said contacting and separating means being adapted to produce a second overhead vapor stream and a bottom liquid stream;

(7) said distillation column being connected to said contacting and separating means to receive at least a portion of said bottom liquid stream, said distillation column being further connected to said contacting and separating means to direct said first overhead vapor stream separated therein to said contacting and separating means at a first lower feed position;

(8) second expansion means connected to said first dividing means to receive said second stream and to expand it to said lower pressure, said second expansion means being further connected to said contacting and separating means to supply said expanded second stream to said contacting and separating means at a second lower feed position;

(9) vapor withdrawing means connected to said contacting and separating means to receive a distillation vapor stream from a region of said contacting and separating means below said expanded cooled combined stream;

(10) first compressing means connected to said vapor withdrawing means to receive said distillation vapor stream and to compress it to an intermediate pressure;

(11) heat exchange means connected to said first compressing means to receive said compressed distillation vapor stream and to cool it sufficiently to condense at least a part of it, thereby forming a condensed stream;

(12) third expansion means connected to said heat exchange means to receive at least a portion of said condensed stream and to expand it to said lower pressure, said third expansion means being further connected to said contacting and separating means to supply said at least a portion of said expanded condensed stream to said contacting and separating means at a second mid-column feed position located above said expanded cooled combined stream;

(13) fourth expansion means connected to said separating means to receive any remaining portion of said at least one liquid stream and to expand it to said lower pressure, said fourth expansion means being further connected to said distillation column to supply said expanded liquid stream to said distillation column at a mid-column feed position;

(14) said contacting and separating means being further connected to said heat exchange means to direct at least a portion of said second overhead vapor stream separated therein into heat exchange relation with said compressed distillation vapor stream and to heat said second overhead vapor stream, thereby to supply at least a portion of the cooling of step (11);

(15) second compressing means connected to said heat exchange means to receive said heated second overhead vapor stream and compress it to higher pressure;

(16) second dividing means connected to said second compressing means to receive said compressed heated second overhead vapor stream and divide it into said volatile residue gas fraction and a compressed recycle stream;

(17) third cooling means connected to said second dividing means to receive said compressed recycle stream and cool it sufficiently to substantially condense it;

(18) fifth expansion means connected to said third cooling means to receive said substantially condensed compressed recycle stream and expand it to said lower pressure, said fifth expansion means being further connected to said contacting and separating means to supply said expanded condensed recycle stream to said contacting and separating means at a top feed position; and

(19) control means adapted to regulate the quantities and temperatures of said feed streams to said contacting and separating means to maintain the overhead temperature of said contacting and separating means at a temperature whereby the major portions of the components in said relatively less volatile fraction are recovered.

32. The improvement according to claim 31 wherein (1) a third dividing means is connected to said contacting and separating means to receive said second overhead vapor stream and divide it into at least a first vapor stream and a second vapor stream;

(2) a second combining means is connected to said third dividing means and said vapor withdrawing means to receive said first vapor stream and said distillation vapor stream and form a combined vapor stream;

(3) said first compressing means is adapted to be connected to said second combining means to receive said combined vapor stream and compress it to said intermediate pressure;

(4) said heat exchange means is adapted to receive said compressed combined vapor stream and cool it sufficiently to condense at least a part of it, thereby forming said condensed stream;

(5) said heat exchange means is further adapted to be connected to said third dividing means to receive said second vapor stream and direct it into heat exchange relation with said compressed combined vapor stream and to heat said second vapor stream, thereby to supply at least a portion of the cooling of step (4);

(6) said second compressing means is adapted to receive said heated second vapor stream and compress it to said higher pressure; and (7) said second dividing means is adapted to receive said compressed heated second vapor stream and divide it into said volatile residue gas fraction and said compressed recycle stream.

33. The improvement according to claim 30 or 32 wherein (1) a fourth dividing means is connected to said heat exchange means to receive said condensed stream and divide it into at least a first portion and a second portion;

(2) said third expansion means is adapted to be connected to said fourth dividing means to receive said first portion and expand it to said lower pressure, said third expansion means being further connected to said contacting and separating means to supply said expanded first portion to said contacting and separating means at said second mid-column feed position; and (3) a sixth expansion means is connected to said fourth dividing means to receive said second portion and expand it to said lower pressure, said sixth expansion means being further connected to said contacting and separating means to supply said expanded second portion to said contacting and separating means at a mid-column feed position below that of said expanded first portion.

34. The improvement according to claim 29 or 31 wherein (1) a third dividing means is connected to said heat exchange means to receive said condensed stream and divide it into at least a first portion and a second portion;

(2) said third expansion means is adapted to be connected to said third dividing means to receive said first portion and expand it to said lower pressure, said third expansion means being further connected to said contacting and separating means to supply said expanded first portion to said contacting and separating means at said second mid-column feed position; and (3) a sixth expansion means is connected to said third dividing means to receive said second portion and expand it to said lower pressure, said sixth expansion means being further connected to said contacting and separating means to supply said expanded second portion to said contacting and separating means at a mid-column feed position below that of said expanded first portion.

* * * * *